US011390085B2

(12) United States Patent
Matsunaga et al.

(10) Patent No.: US 11,390,085 B2
(45) Date of Patent: Jul. 19, 2022

(54) WIPING DEVICE

(71) Applicant: Riso Kagaku Corporation, Tokyo (JP)

(72) Inventors: Katsuhiko Matsunaga, Ibaraki (JP); Ami Nakata, Ibaraki (JP); Hirotaka Yamamoto, Ibaraki (JP); Moon-Ho Lee, Chungcheongnam-do (KR)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/934,423

(22) Filed: Jul. 21, 2020

(65) Prior Publication Data

US 2021/0023846 A1 Jan. 28, 2021

(30) Foreign Application Priority Data

| | | |
|---|---|---|
| Jul. 26, 2019 | (JP) | JP2019-138048 |
| Jul. 26, 2019 | (JP) | JP2019-138049 |
| Jul. 26, 2019 | (JP) | JP2019-138050 |
| Feb. 26, 2020 | (JP) | JP2020-031062 |

(51) Int. Cl.
*B41J 2/165* (2006.01)

(52) U.S. Cl.
CPC ..... *B41J 2/16544* (2013.01); *B41J 2/16552* (2013.01); *B41J 2002/16558* (2013.01)

(58) Field of Classification Search
CPC ..... B41J 2/16544; B41J 2/16552; B41J 2002/16558; B41J 2/16538; B41J 2/16517
See application file for complete search history.

(56) References Cited

U.S. PATENT DOCUMENTS

| | | | | |
|---|---|---|---|---|
| 2009/0122105 | A1 | 5/2009 | Vamamoto et al. | |
| 2020/0254761 | A1 * | 8/2020 | Levy | B41J 2/165 |

FOREIGN PATENT DOCUMENTS

| | | | | |
|---|---|---|---|---|
| EP | 2979874 | A1 * | 2/2016 | B41J 2/16535 |
| JP | 2002-79681 | A | 3/2002 | |
| JP | 2006305772 | A * | 11/2006 | |
| JP | 2008-290313 | A | 12/2008 | |
| JP | 4954852 | B2 | 6/2012 | |
| JP | 5026236 | B2 | 9/2012 | |
| JP | 2016-32930 | A | 3/2016 | |
| JP | 2016-155279 | A | 9/2016 | |
| JP | 6147582 | B2 | 6/2017 | |

* cited by examiner

*Primary Examiner* — Sharon Polk
(74) *Attorney, Agent, or Firm* — Greenblum & Bernstein, P.L.C.

(57) ABSTRACT

A wiping device is equipped with a wiping blade that wipes an ink ejection surface of a nozzle row of an ink jet head, a cleansing tank that stores a cleansing solution and in which the wiping blade is immersed, and a shower unit that sprays the cleansing solution onto the wiping blade.

9 Claims, 24 Drawing Sheets

FIRST INK REMOVING OPERATION

SECOND INK REMOVING OPERATION

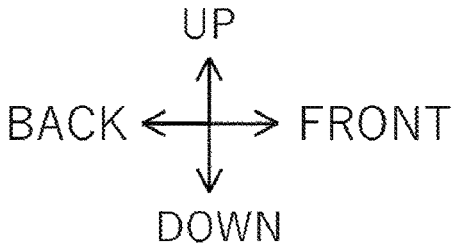
FIG.13
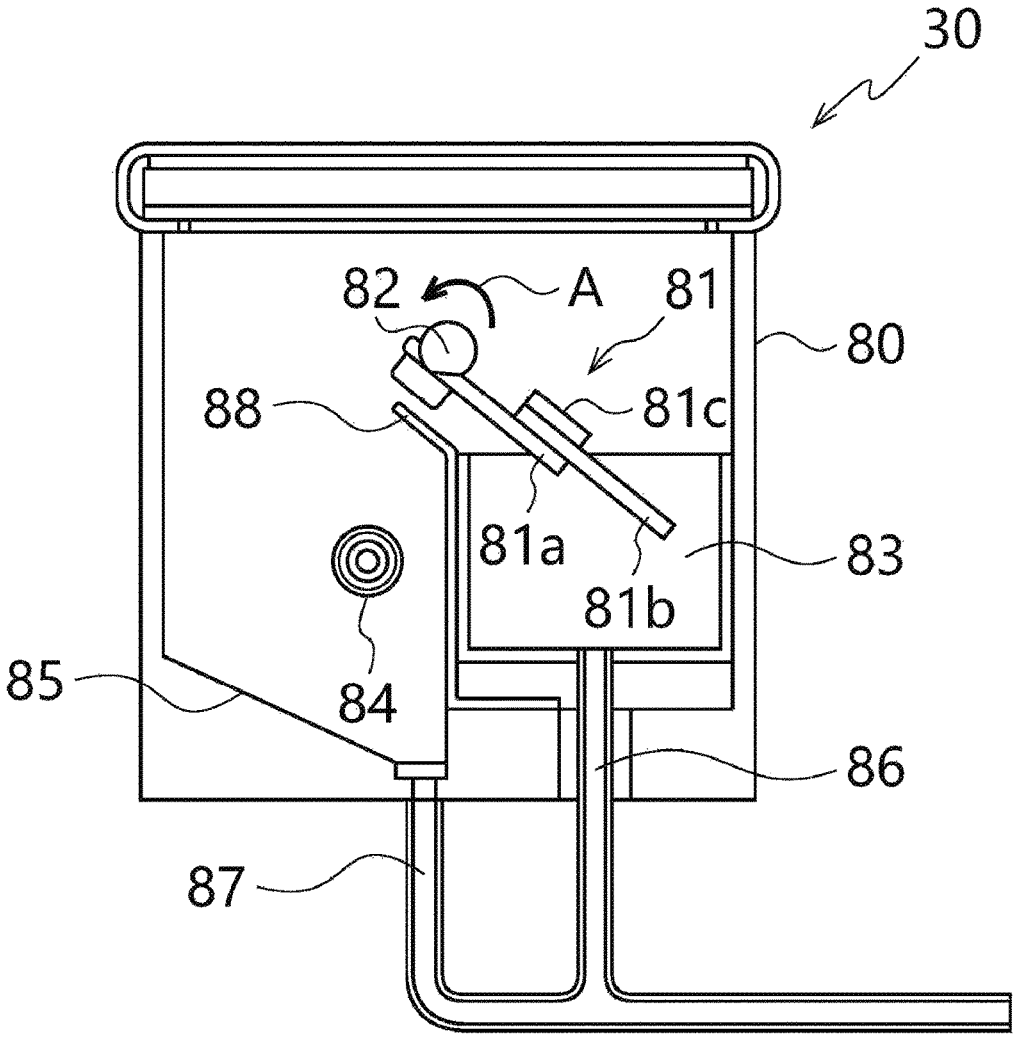

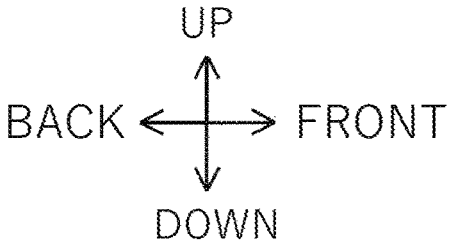
FIG.17
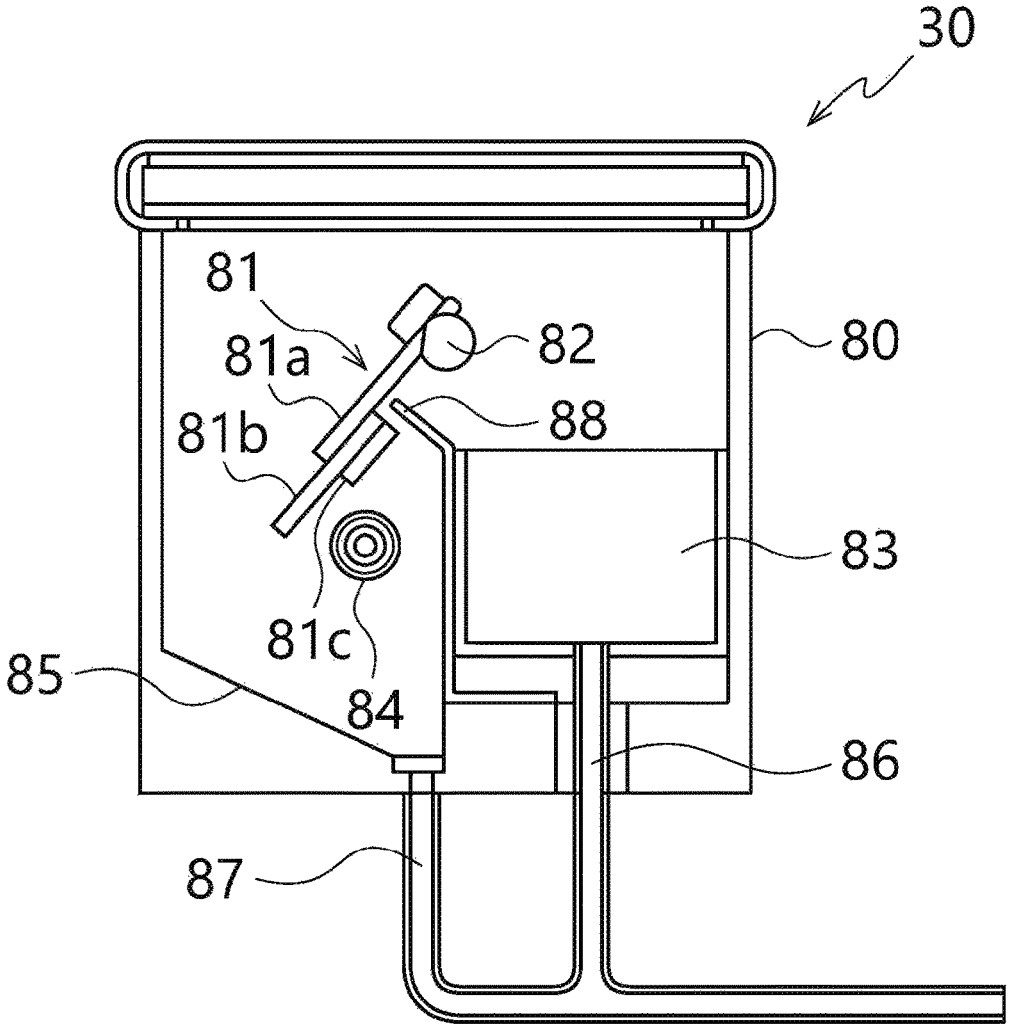

WIPING DEVICE

CROSS-REFERENCE TO RELATED APPLICATIONS

The present application claims priority under 35 U.S.C. § 119 to Japanese Patent Application No. 2019-138049, filed on Jul. 26, 2019, Japanese Patent Application No. 2019-138050, filed on Jul. 26, 2019, Japanese Patent Application No. 2019-138048, filed on Jul. 26, 2019 and Japanese Patent Application No. 2020-31062, filed on Feb. 26, 2020. The above application is hereby expressly incorporated by reference, in its entirety, into the present application.

BACKGROUND OF THE INVENTION

1. Field of the Invention

The present invention is related to a wiping device that wipes an ink ejection surface of a nozzle row of an ink jet head.

2. Description of the Related Art

Conventionally, ink jet printing apparatuses that administer printing onto print media such as paper and film by ejecting ink from ink jet heads have been proposed. In addition, employing such ink jet printing apparatuses to conduct printing processes on base materials such as building materials and decorative panels has also been proposed.

There are cases in which ink becomes fixed or paper dust from printing sheets becomes adhered onto ink ejection outlets of nozzles in ink jet printing apparatuses. In the case that ink is fixed or paper dust is accumulated onto the ink ejection outlets of the nozzles, there may be cases in which ejection failures, such as deviance in the ejection direction of ink from the nozzles or non-ejection, will occur.

A series of operations for reducing such ejection failures is known. First, ink is forcibly ejected from nozzles of an ink jet head, to conduct a so called "purge". Next, a wiping blade wipes along ink ejection outlets of the nozzles. Thereby, ink which is fixed onto the ink ejection outlets of the nozzles as well as debris which is present on the ink ejection outlets of the nozzles are removed by the wiping blade. In addition, deterioration in the water repelling properties of an ink ejection surface and drying of the nozzles are prevented.

The wiping operation described above enables contaminants to be removed from the ink ejection outlets. However, the wiping operation also results in the wiping blade being contaminated.

Therefore, Japanese Patent No. 4954852 proposes a method in which a wiping blade which is contaminated with ink is caused to contact a sponge or the like, and then immersed in a cleansing tank which is filled with a cleansing solution.

In addition, Japanese Unexamined Patent Publication No. 2016-155279 proposes a method for improving the maintenance performance of a maintenance mechanism of a head that employs a wet type wiping means in which a wiping blade is moistened.

Further, Japanese Unexamined Patent Publication No. 2008-290313 proposes a method in which a nozzle surface of an ink jet head is wiped by a rotatable wiping blade, and then the wiping blade is immersed in a cleansing tank.

Still further, Japanese Unexamined Patent Publication No. 2002-79681 discloses that a wiping blade wipes a nozzle surface of an ink jet head, the wiping blade moves to a region external to nozzles thereafter, and then the wiping blade is vibrated to remove liquid and debris which are attached thereto.

SUMMARY OF THE INVENTION

However, in the method which is disclosed in Japanese Patent No. 4954852, there are cases in which the wiping blade will be recontaminated by the sponge which is contaminated by ink and the cleansing solution which has been utilized previously.

In addition, the method which is proposed in Japanese Unexamined Patent Publication No. 2016-1155279 performs a wiping operation after impregnating a wiping blade which is formed by a porous material with a cleansing solution. However, deformation and bloating of the porous material occurs due to being moistened by the cleansing solution. As a result, there is a possibility that the porous wiping blade cannot be pressed against the ink jet head uniformly, thereby decreasing wiping performance.

Further, in the method which is proposed in Japanese Unexamined Patent Publication No. 2008-290313, there are cases in which ink that adheres to the wiping blade due to a wiping operation contaminates the cleansing solution within the cleansing tank, resulting in recontamination of the wiping blade.

Still further, ink and the like that become adhered to a wiping blade cannot be sufficiently removed merely by vibrating the wiping blade as in the method which is disclosed in Japanese Unexamined Patent Publication No. 2002-79681.

The present invention has been developed in view of the foregoing circumstances. It is an object of the present invention to provide a wiping device which is capable of wiping an ink jet head with a wiping blade which is always wetted with an uncontaminated cleansing solution.

A wiping device of the present invention is equipped with: a wiping blade for wiping an ink ejection surface of a nozzle row of an ink jet head having the nozzle row in which a plurality of nozzles for ejecting ink are arranged; a cleansing tank in which a cleansing solution is stored and the wiping blade is immersed; and a spraying unit that sprays the cleansing solution onto the wiping blade.

The wiping device of the present invention is equipped with the cleansing tank in which the wiping blade is immersed and the spraying unit that sprays the cleansing solution onto the wiping blade. Therefore, it is possible for the wiping blade to be cleansed by the spraying unit with uncontaminated cleansing solution, and for the cleansed wiping blade to be immersed into the cleansing tank. Accordingly, contamination of the cleansing solution within the cleansing tank can also be prevented. Therefore, it is possible to wipe an ink jet head with a wiping blade which is always wetted with an uncontaminated cleansing solution.

BRIEF DESCRIPTION OF THE DRAWINGS

FIG. 13 is a diagram that illustrates the inner configuration of a wiping unit.

FIG. 17 is a diagram that illustrates the position of a wiping blade during spraying of the cleansing solution.

DETAILED DESCRIPTION OF THE EMBODIMENTS

Figure 1:
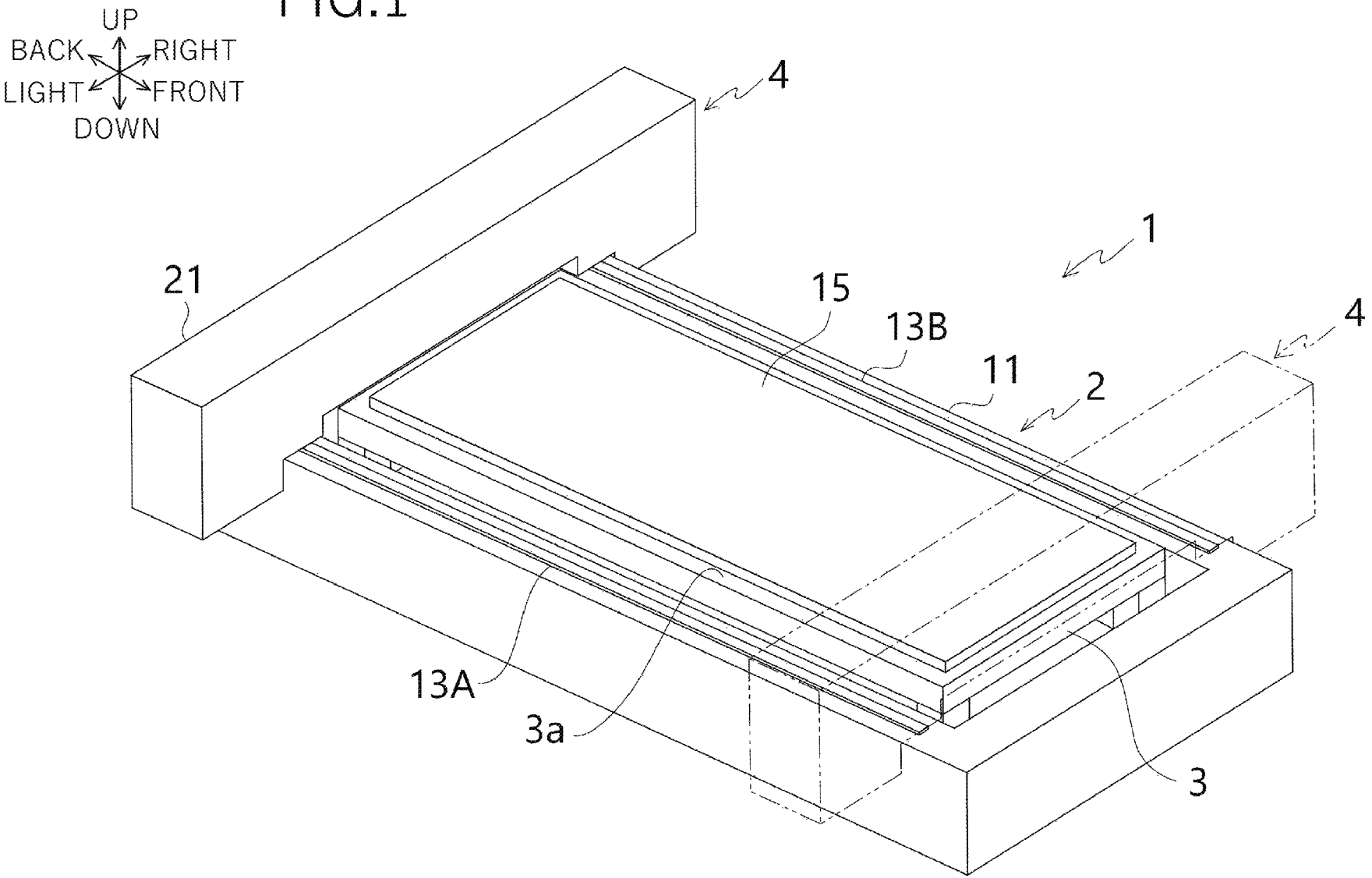
FIG. 1 is a perspective view that illustrates the schematic configuration of an ink jet printing apparatus according to a first embodiment of the present invention.

Hereinafter, an ink jet printing apparatus that employs an embodiment of a wiping device of the present invention will be described in detail with reference to the attached drawings. The ink jet printing apparatus according to the present embodiment is characterized by a wiping operation of an ink jet head. First, the overall configuration of the ink jet printing apparatus will be described. FIG. 1 is a perspective view that illustrates the schematic configuration of an ink jet printing apparatus 1 according to the present embodiment. Note that in the description of the embodiment below, the up, down, left, right, front, and back directions which are indicated by the arrows in FIG. 1 will be designated as the up, down, left, right, front, and back directions in the ink jet printing apparatus 1.

As illustrated in FIG. 1, the ink jet printing apparatus 1 of the present embodiment is equipped with a shuttle base unit 2, a flat bed unit 3, and a shuttle unit 4.

The shuttle base unit 2 supports the shuttle unit 4 and moves the shuttle unit 4 in the front to back direction (sub scanning direction). Specifically, the shuttle base unit 2 is equipped with a gantry unit 11 and a sub scanning drive motor 12 (refer to FIG. 18).

The gantry section 11 is formed in the shape of a rectangular frame and supports the shuttle unit 4. Sub scanning drive guides 13A and 13B that extend in the front to back direction are respectively formed above the left and right sides of the frame of the gantry section 11. The sub scanning drive guides 13A and 13B guide the shuttle unit 4 so as to move in the front to back direction. The sub scanning drive motor 12 moves the shuttle unit 4 in the front to back direction.

The flat bed unit 3 supports a print medium 15 such as a building material or a decorative panel. The flatbed unit 3 is arranged in a rectangular parallelepiped shaped recess formed inside the gantry section 11 of the shuttle base unit 2. The flat bed unit 3 has a medium placement surface 3*a*, which is a horizontal surface on which the print medium 15 is placed. The flat bed unit 3 has an elevating mechanism which is equipped with a hydraulic drive mechanism (not shown) or the like. This configuration enables the height of the medium mounting surface 3*a* to be adjusted.

Figure 2:
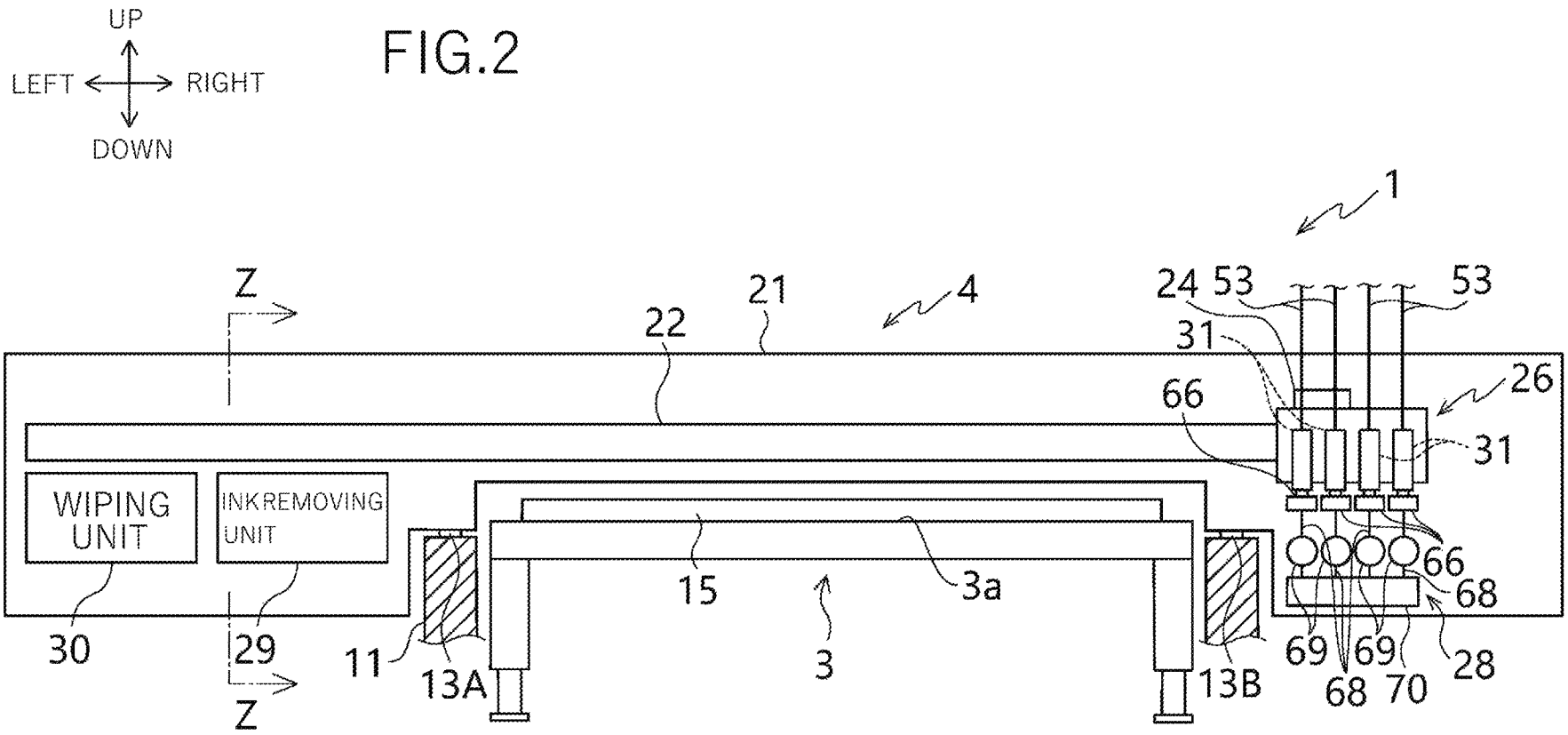
FIG. 2 is a diagram that illustrates the schematic configuration of a shuttle unit.

The shuttle unit 4 performs printing processes on the print medium 15. FIG. 2 is a diagram that illustrates the schematic configuration of the shuttle unit 4. As illustrated in FIG. 2, the shuttle unit 4 is equipped with a housing 21, a main scanning drive guide 22, a main scanning drive motor 23 (refer to FIG. 18), a head elevating guide 24, a head elevating motor 25 (refer to FIG. 18), a head unit 26, a capping unit 66, a suction unit 28, an ink removing unit 29, and a wiping unit 30.

The housing 21 accommodates components such as the head unit 26. The housing 21 is formed in the shape of a gate that straddles the flatbed unit 3 in the left to right direction. The housing 21 is supported by the gantry unit 11 of the shuttle base unit 2 and is configured to be movable along the sub scanning drive guides 13A and 13B.

The main scanning drive guide 22 guides the head unit 26 so as to move in the left to right direction (main scanning direction). The main scanning drive guide 22 is formed by an elongated member that extends in the left to right direction. The head unit 26 is moved in the left to right direction by the main scanning drive motor 23.

The head elevating guide 24 guides the head unit 26 so as to move in the vertical direction. The head elevating guide 24 is formed by a vertically elongated member. The head elevating guide 24 is configured to be movable in the left to right direction along with the head unit 26 along the main scanning drive guide 22. The head unit 26 is moved in the vertical direction by the head elevating motor 25.

The head unit 26 performs a printing process by ejecting ink onto the print medium 15 while moving in the left to right direction along the main scanning drive guide 22 as described above. The head unit 26 has four ink jet heads 31, as illustrated in FIG. 2. Note that the number of ink jet heads 31 is not limited to four, and five or more ink jet heads 31 may be provided in the head unit 26, for example.

Figure 3:
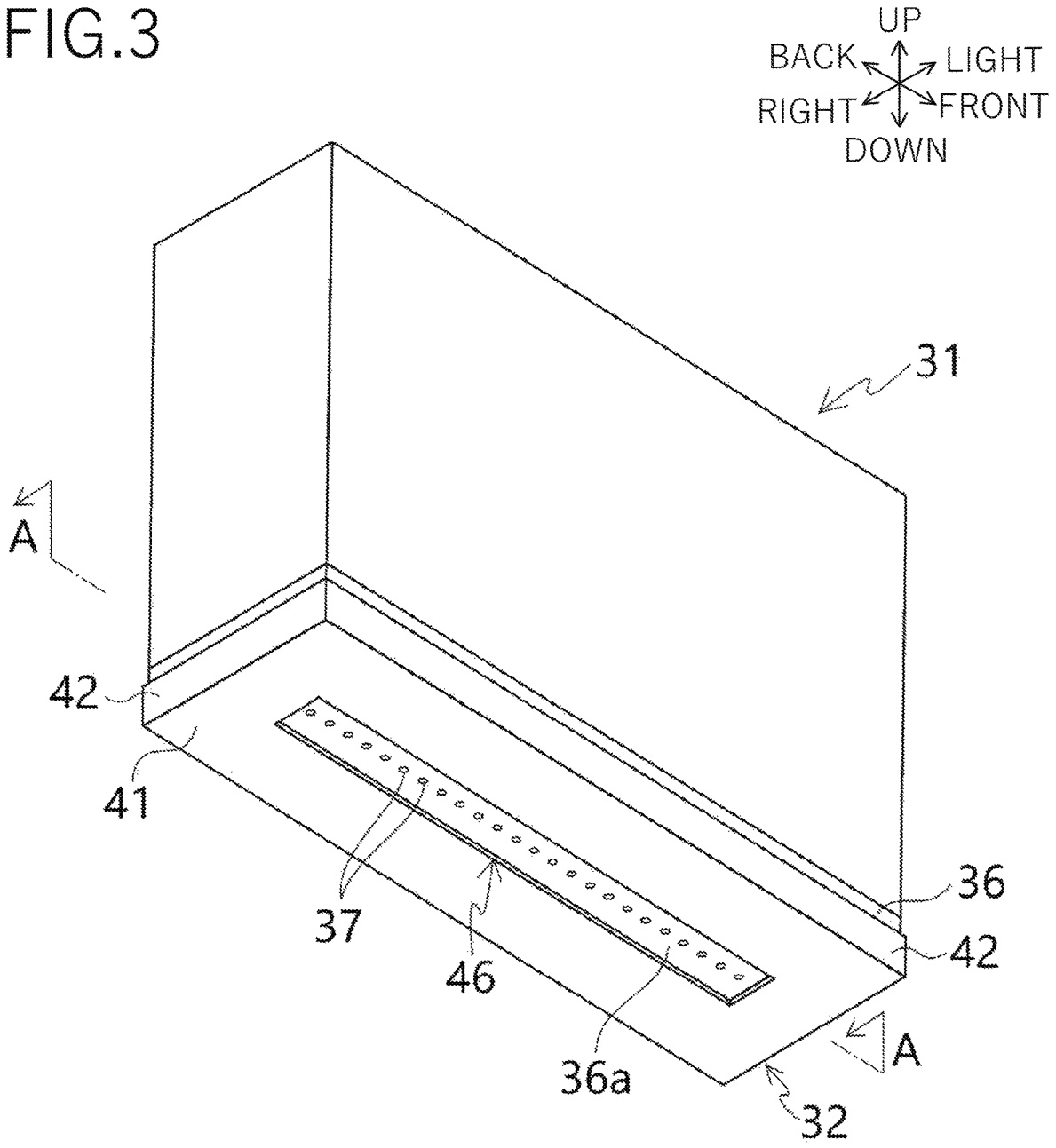
FIG. 3 is a perspective view that illustrates the outer appearance of an ink jet head.
Figure 4:
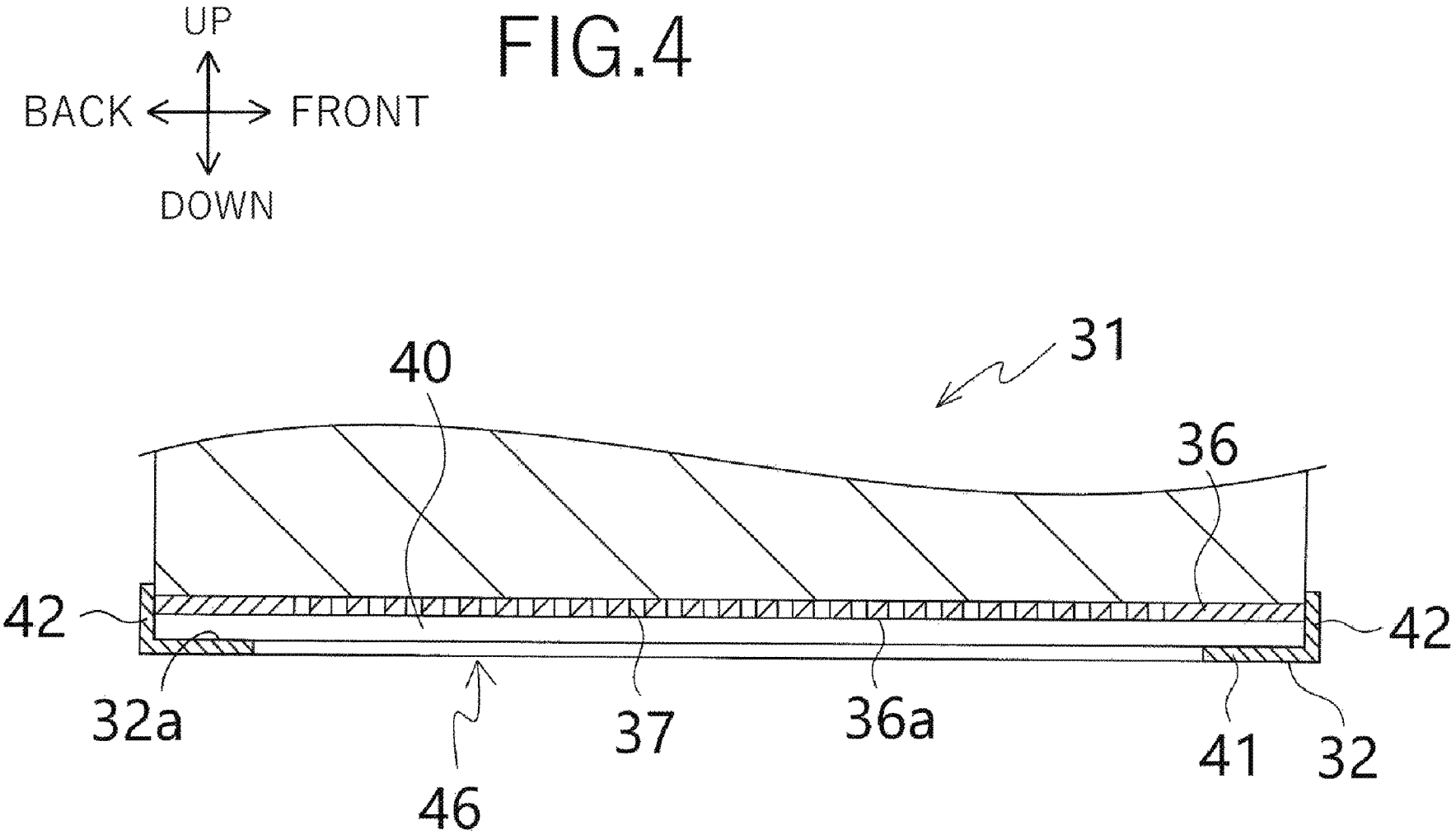
FIG. 4 is a diagram that partially illustrates a cross section taken along line A-A of the ink jet head illustrated in FIG. 3

FIG. 3 is a perspective view that illustrates the outer appearance of an ink jet head 31, and FIG. 4 is a diagram that illustrates a portion of a cross section of the ink jet head 31 taken along line A-A of FIG. 3.

As illustrated in FIG. 3, the ink jet head 31 is equipped with a nozzle plate 36 and a nozzle guard 32. The nozzle plate 36 has a nozzle row in which a plurality of ink ejection outlets 37 of the nozzles that eject ink are arranged in the front to back direction.

As illustrated in FIGS. 3 and 4, the nozzle guard 32 has an opening 46 in a portion corresponding to the nozzle row of the nozzle plate 36, and is provided on the ink ejection surface 36*a* of the nozzle row with a gap 40 therebetween. Note that in the present embodiment, the ink ejection surface 36*a* is a surface on which the openings of the ink ejection outlets 37 of the nozzles are arranged, and is the same surface as the surface of the nozzle plate 36.

The nozzle guard 32 protects the ink ejection surface 36*a* of the nozzle plate 36. Specifically, the nozzle guard 32 has a bottom plate 41 which is formed so as to cover the periphery of the nozzle row, and a side wall 42 which is erected on the peripheral edge of the bottom plate 41. The aforementioned opening 46 is formed in the bottom plate 41, and the gap 40 is formed between the bottom plate 41 and the ink ejection surface 36*a*. The opening 46 is formed in a rectangular shape which is elongated in the front to back direction such that the ink ejection outlets 37 of all the nozzles are exposed. The gap 40 is formed by a space between the bottom plate 41 of the nozzle guard 32 and the peripheral edge of the ink ejection surface 36*a* that faces the bottom plate 41 when the nozzle guard 32 is attached to the nozzle plate 36.

Returning to FIG. 2, the four ink jet heads 31 are arranged side by side in the left to right direction. The four ink jet heads 31 eject ink of different colors (for example, cyan, black, magenta, and yellow).

One end of an ink supply pipe 53 is connected to each of the ink jet heads 31. A supply pump 55 (refer to FIG. 18) is provided in the ink supply pipe 53, and the supply pump 55 operates to supply the inks to the ink jet heads 31 via the ink supply pipe 53.

The capping unit 66 seals the opening 46 of the nozzle guard 32 in order to prevent the ink ejection outlets 37 of the nozzles from drying while the ink jet printing apparatus 1 is in a standby state in which a printing process is not being performed.

The capping unit 66 is installed in the interior of the housing 21 at the right end portion thereof, as illustrated in FIG. 2. The head unit 26 hermetically seals the opening 46 of the nozzle guard 32 when the head unit 26 moves to a standby position at the right end of the housing 21.

Figure 5:
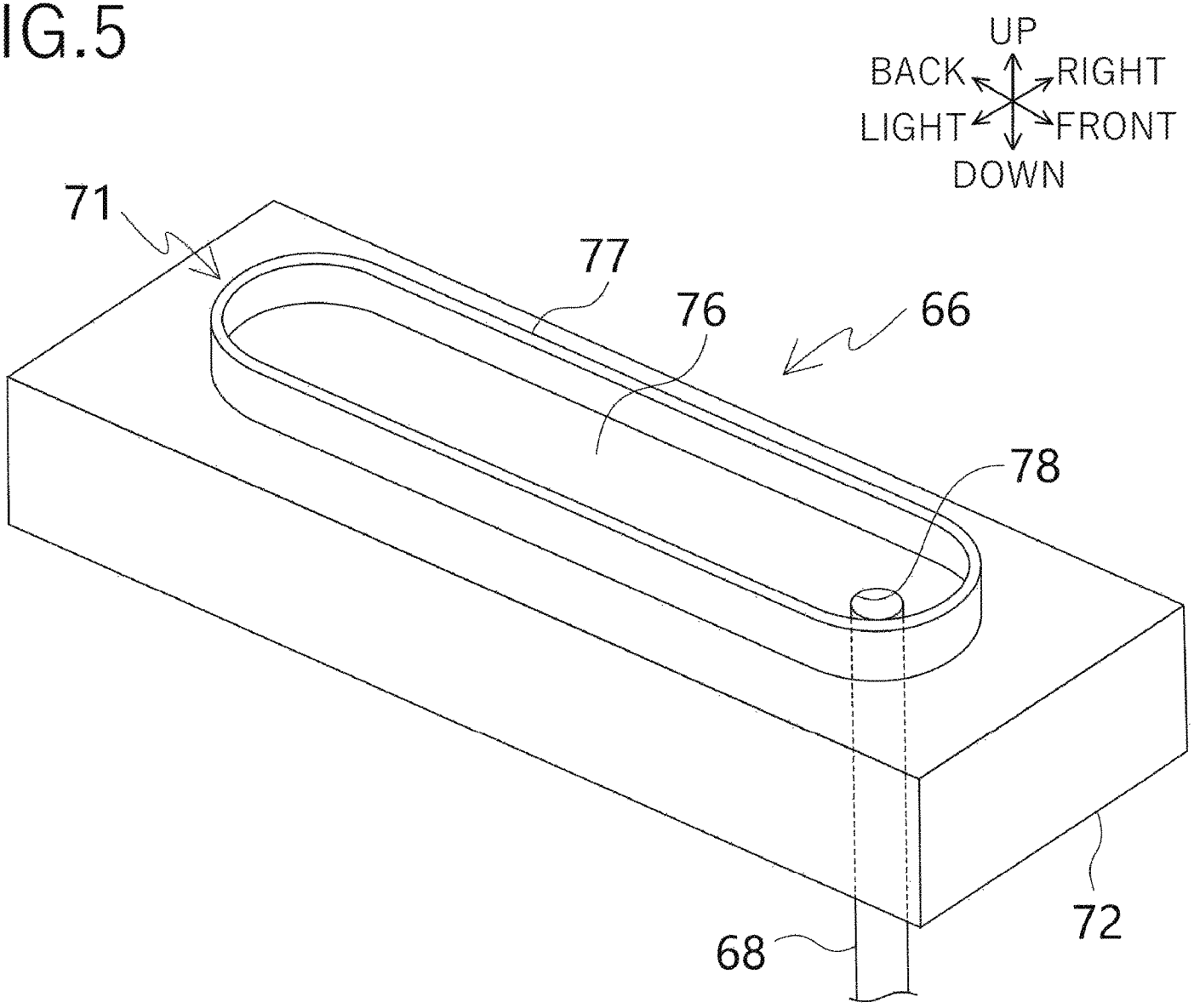
FIG. 5 is a diagram that illustrates the schematic configuration of a capping unit.

The capping unit 66 is equipped with a cap 71 and a cap base 72, as illustrated in FIG. 5. The cap 71 is equipped with an oval bottom portion 76 and a peripheral wall 77 which is erected on the periphery of the bottom portion 76. A suction aperture 78 for suctioning the ink which is ejected from the ink jet head 31 during purging is formed in the bottom portion 76. A suction pipe 68 of the suction unit 28 to be described later is connected to the suction aperture 78. The cap base 72 is a base on which the cap 71 is formed.

Figure 18:
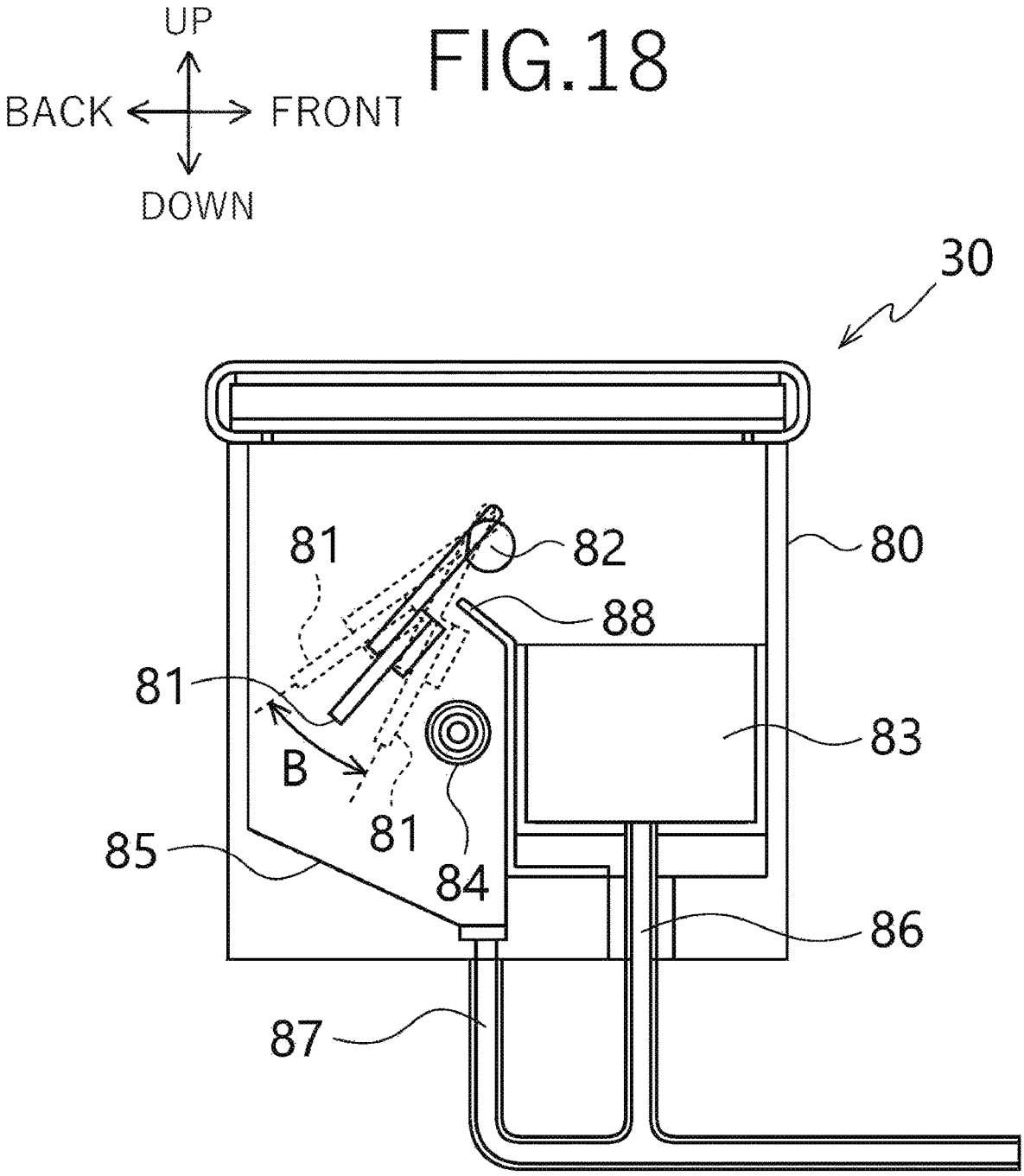
FIG. 18 is a diagram that illustrates the manner in which the wiping blade is reciprocally rotated.

The capping unit 66 is moved in the vertical direction by a cap elevating motor 67 (refer to FIG. 18). Specifically, the capping unit 66 moves up and down between a contact position at which the peripheral wall 77 of the cap 71 contacts the nozzle guard 32, and a retracted position below the contact position.

The suction unit 28 provided below the capping unit 66 suctions ink which is accumulated in the capping unit 66. The suction unit 28 is equipped with four suction pipes 68, four suction pumps 69, and a waste liquid tank 70.

One end of each of the four suction pipes 68 is connected to the suction aperture 78 which is formed in the bottom portion 76 of each of the four caps 71, and the other end of each of the four suction pipes 68 is connected to the waste liquid tank 70. A suction pump 69 is provided for each suction pipe 68.

The ink which is accumulated in the capping unit 66 flows out to the suction aperture 78 of each cap 71 due to suction by the suction pump 69, and is stored in the waste liquid tank 70 via each of the suction pipes 68.

Incidentally, a series of operations for reducing ejection failures due to contamination of ink ejection outlets of nozzles is conventionally known, as described above. First, ink is forcibly ejected from nozzles of an ink jet head, to conduct a so called "purge". Next, a wiping blade wipes along ink ejection outlets of the nozzles. Thereby, ink which is fixed onto the ink ejection outlets of the nozzles as well as debris which is present on the ink ejection outlets of the nozzles are removed by the wiping blade.

Here, as in the ink jet head 31 of the present embodiment, there are ink jet heads in which a gap 40 is present between the ink ejection surface 36*a* and the nozzle guard 32. When the purging and wiping operations described above are performed in such an ink jet head 31, a portion of the ink which is adhered to the ink ejection surface 36*a* enters the gap 40 between the ink ejection surface 36*a* and the nozzle guard 32.

For example, when the printing process is performed while moving the ink jet head 31 as in the present embodiment, there is a possibility that ink, which has entered the gap 40, will move toward the opening 46 of the nozzle guard 32 due to the movement of the ink jet head 31 during the printing process. The ink which has moved in this manner may block the ink ejection outlets 37 of the nozzles, resulting in ejection failure.

Further, in the standby state during which a printing process is not being performed, the opening 46 of the nozzle guard 32 is sealed by the cap 71 and the tip of the nozzle is protected from drying. However, there is a possibility that the ink which has entered the gap 40 will moves toward the opening 46 of the nozzle guard 32 due to repeated opening and closing operations of the cap 71. The ink which has moved in this manner may block the ink ejection outlets 37 of the nozzles, resulting in ejection failure.

In addition, in order to perform favorable ink ejection from the nozzles, it is necessary for a meniscus to be formed in each of the ink ejection outlets 37 of the nozzles. However, in the case that the ink within the gap 40 described above remains near the ink ejection outlets 37 of the nozzles, it becomes difficult to form a meniscus and favorable ink ejection cannot be performed.

For example, Japanese Unexamined Patent Publication No. 2016-32930 proposes a device that performs a wiping operation by moving a wiping blade from one short side of two opposing short sides of a rectangular ink ejection surface to the other short side.

However, it is very difficult to remove the aforementioned ink which has entered the gap 40 by the wiping operation disclosed in Japanese Unexamined Patent Publication No. 2016-32930. For example, in the case that a wiping operation is performed by moving the wiping blade from one short side of the rectangular ink ejection surface toward the other short side as disclosed in Japanese Unexamined Patent Publication No. 2016-32930, although there is a possibility that the ink within the gap at one short side can be removed, it is difficult to remove the ink from the gaps at the remaining three sides.

Further, Japanese Patent No. 5026236 proposes sealing an ink jet head with a cap and suctioning ink to perform a cleaning operation of the ink jet head. Further, Japanese Patent No. 6147582 proposes a method in which a pressure with which a cap is pressed against an ink jet head is weakened when the cap that seals an ink ejection surface of an ink jet head is employed to perform suction to conduct maintenance, thereby suppressing seepage of ink within a gap between the ink ejection surface and a nozzle guard onto the ink ejection surface.

However, the methods which are disclosed in Japanese Patent No. 5026236 and Japanese Patent No. 6147582 are not methods of directly removing the ink within the gap between the nozzle guard and the ink ejection surface. Therefore, there is a possibility that the ink within the gap will move onto the ink ejection surface due to the movement of the ink jet head, and the moved ink may block the ink ejection outlet of the nozzle, resulting in ejection failure as described above.

Therefore, the ink jet printing apparatus 1 of the present embodiment is equipped with the ink removing unit 29 for removing the ink within the gap between the nozzle guard 32 and the ink ejection surface 36*a*.

The ink removing unit 29 is installed inside the left end portion of the housing 21 of the shuttle unit 4 as illustrated in FIG. 2. The ink removing unit 29 is a mechanism that removes ink which has entered the gap 40 formed between the bottom plate 41 of the nozzle guard 32 and the ink ejection surface 36*a* by pressing an absorbing member 50 that absorbs ink against the nozzle guard 32 and the ink ejection surface 36*a* of the ink jet head 31.

Here, in the case that the absorbing member 50 is pressed against the opening 46 of the nozzle guard 32 and the ink ejection surface 36*a* of the ink jet head 31 to remove the ink within the gap 40 as described above, if a sheet shaped absorbing member 50 which is cut approximately to the size of the ejection surface 36*a*, for example, is employed as the absorbing member 50, it will be necessary to exchange the absorbing member 50 each time it is pressed against the ink ejection surface 36*a*, and maintenance properties will be poor. Therefore, in the ink removing unit 29 of the present embodiment, a rolled absorbing member R which is a long absorbing member 50 wound in the form of a roll is employed instead of the sheet shaped absorbing member 50 described above.

Figure 6:
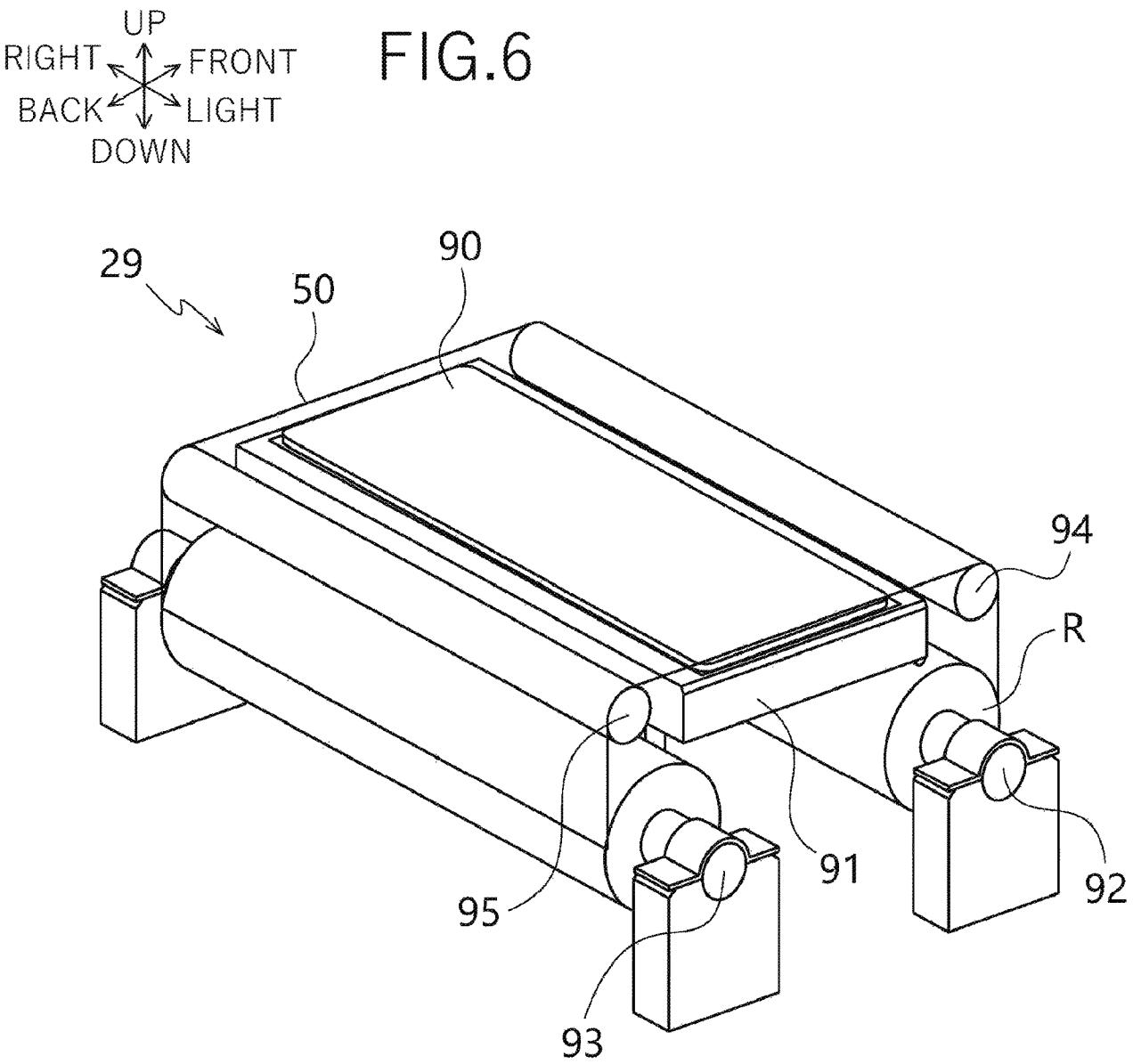
FIG. 6 is a perspective view that illustrates the outer appearance of an ink removing unit.
Figure 7:
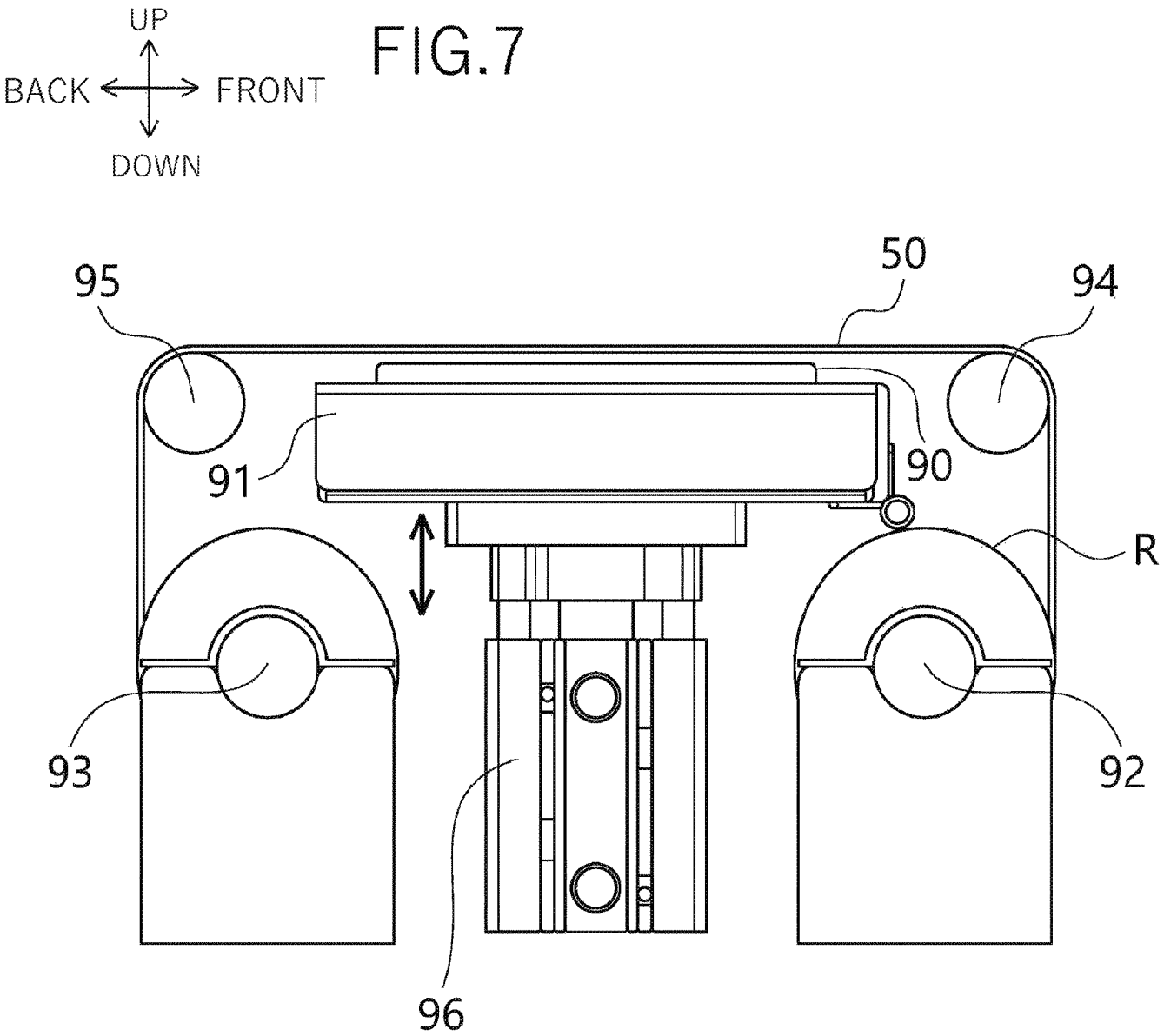
FIG. 7 is a left side view of the ink removing unit illustrated in FIG. 6.

FIG. 6 is a perspective view that illustrates the outer appearance of the ink removing unit 29. FIG. 7 is a left side view of the ink removing unit 29 illustrated in FIG. 6. As illustrated in FIGS. 6 and 7, the ink removing unit 29 is equipped with a pressing base 91, a feed roller 92, a winding roller 93, a feed side conveyance roller 94, a winding side conveyance roller 95, and a pressing base elevating mechanism 96. In the present embodiment, the feed roller 92, the winding roller 93, the feed side conveyance roller 94, the winding side conveyance roller 95, and a winding motor 29*a* to be described later correspond to the conveyance unit of the present invention. Further, the pressing base 91, the pressing base elevating mechanism 96 and a pressing base elevating motor 29*b* to be described later correspond to the pressing unit of the present invention.

The feed roller 92, the feed side conveyance roller 94, the winding side conveyance roller 95, and the winding roller 93 are roller members that extend in the left to right direction.

The feed roller 92 is a roller on which the rolled absorbing member R which is the absorbing member 50 wound in the shape of a roll is provided. The feed roller 92 is a roller that feeds the absorbing member 50 which is unwound from the rolled absorbing member R toward the winding roller 93.

The absorbing member 50 may be made of any material as long as it is capable of absorbing ink. However, it is preferable for the absorbing member to be a porous sheet. A printing sheet which has porosity may be employed as the porous sheet.

It is preferable for the width of the absorbing member 50 in the left to right direction (the arrangement direction of the four ink jet heads 31) to be twice the sum of the widths of all of the ink jet heads 31 (four ink jet heads 31 in the present embodiment) in the head unit 26 in the left to right direction or greater.

The feed side conveyance roller 94 is provided above the feed roller 92. The absorbing member 50 which is fed from the feed roller 92 is conveyed in the horizontal direction while contacting the outer circumference of the feed side conveyance roller 94, and is conveyed from the front side to the rear side thereby.

The winding side conveyance roller 95 is provided at the same height as the feed side conveyance roller 94 and is provided above the winding roller 93. The absorbing member 50 which is fed from the feed side conveyance roller 94 is delivered to the winding side conveyance roller 95, and is conveyed vertically downward while contacting the outer periphery of the winding side conveyance roller 95, such that the winding-up of the lower portion of the absorbing member is conveyed toward the roller 93 below.

The winding roller 93 is provided at the same height as the feed roller 92 and is provided below the winding side conveyance roller 95. The winding roller 93 is a roller that winds up the absorbing member 50 which is conveyed downward by the winding side conveyance roller 95.

The winding roller 93 is a drive roller which is rotated by the winding motor 29*a* (refer to FIG. 18). The feed roller 92, the feed side conveyance roller 94, and the winding side conveyance roller 95 are driven rollers that rotate due to friction with the absorbing member 50 which is drawn out from the rolled absorbing member R by the winding roller 93.

The pressing base 91 and the pressing base elevating mechanism 96 are provided between the feed side conveyance roller 94 and the winding side conveyance roller 95. The absorbing member 50 is stretched between the feed side conveyance roller 94 and the winding side conveyance roller 95 with a constant tension. The pressing base 91 is provided below the stretched absorbing member 50 with a predetermined interval therebetween.

The pressing base 91 is a rectangular parallelepiped table made of a material having a certain degree of rigidity such as a metal. A cushion portion 90 is provided on the upper surface of the pressing base 91.

The cushion portion 90 is formed of an elastic member. A sponge cloth, a silicon sheet, a rubber sheet, etc. may be employed as the cushion portion 90, for example.

By providing the cushion portion 90 on the upper surface of the pressing base 91, close contact properties of the absorbing member 50 with respect to the nozzle guard 32 and the ink ejection surface 36*a* can be improved when the absorbing member 50 is pressed against the nozzle guard 32 and the ink ejection surface 36*a* of the ink jet head 31. As a result, it becomes possible to uniformly remove the ink which has seeped out from the gap 40 between the ink ejection surface 36*a* and the nozzle guard 32.

Further, the pressing base elevating mechanism 96 for moving the pressing base 91 in the vertical direction is provided below the pressing base 91. The pressing base elevating mechanism 96 is configured to be driven by a pressing base elevating motor 29*b* (refer to FIG. 18) to expand and contract in the vertical direction. The expanding and contracting operations causes the pressing base 91 to move in the vertical direction.

Figure 8A:
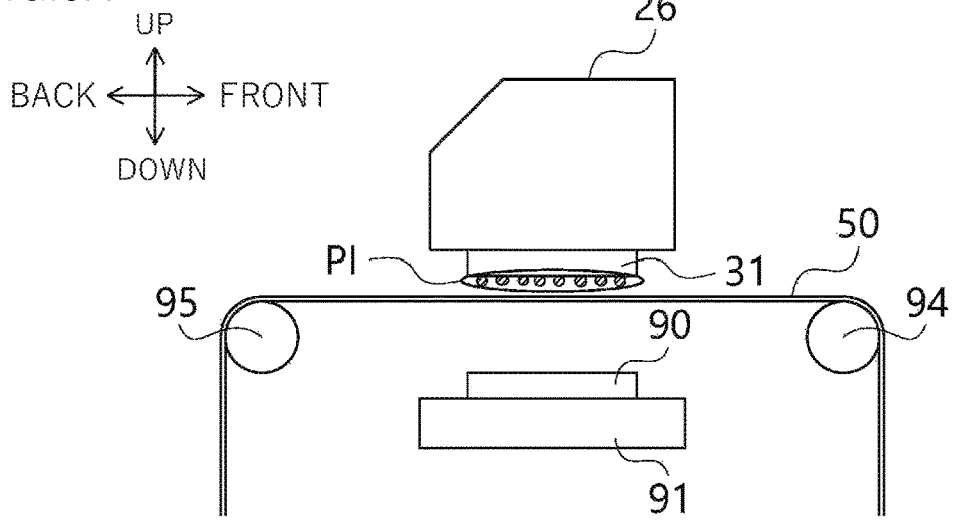
FIG. 8A is a diagram for explaining an ink removing operation which is performed by the ink removing unit.
Figure 8B:
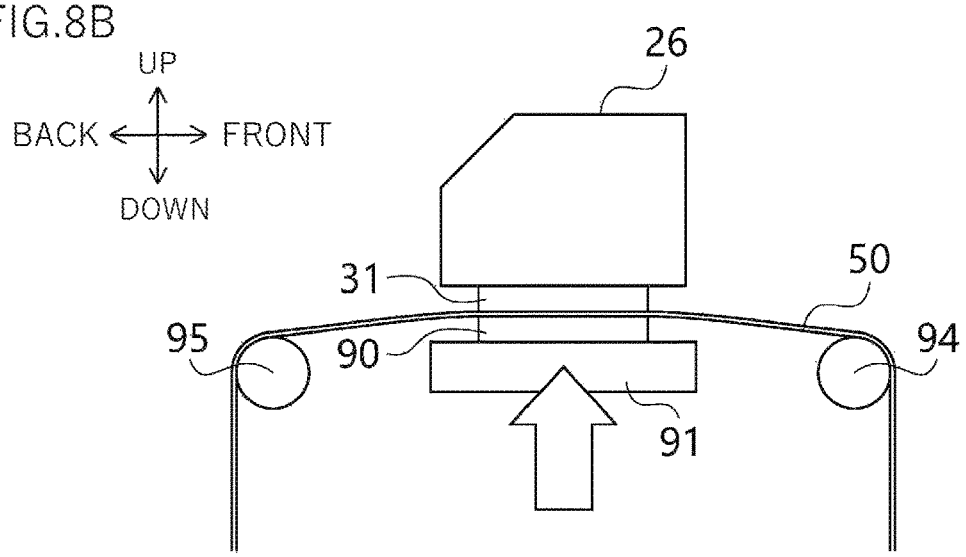
FIG. 8B is a diagram for explaining an ink removing operation which is performed by the ink removing unit.
Figure 8C:
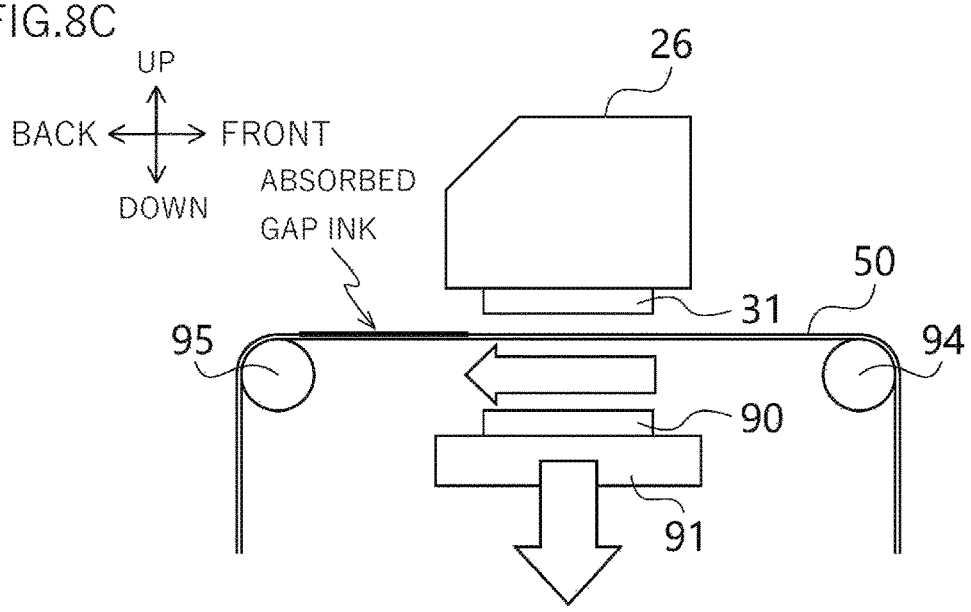
FIG. 8C is a diagram for explaining an ink removing operation which is performed by the ink removing unit.

FIG. 8A~8C is a diagram for explaining the ink removing operation which is performed by the ink removing unit 29 described above. First, the head unit 26 is moved to a position above the absorbing member 50 which is stretched between the feed side conveyance roller 94 and the winding side conveyance roller 95. Then, the ink jet heads 31 are purged in a state where the four ink jet heads 31 of the head unit 26 are arranged above the absorbing member 50 with an interval therebetween. In FIG. 8A, PI indicated by the dotted oval denotes the ink remaining on the ink ejection surface 36*a* of the ink jet head 31 due to the purge.

Then, after the purge described above, the pressing base elevating mechanism 96 extends upward such that the pressing base 91 rises as illustrated in FIG. 8B. The cushion portion 90 and the absorbing member 50 come into contact with each other due to the upward movement of the pressing base 91, and then the absorbing member 50 is pressed against the nozzle guard 32 with a predetermined pressure by further upward movement of the pressing base 91. The ink which has entered the gap 40 formed between the bottom plate 41 of the nozzle guard 32 and the ink ejection surface 36*a* is pushed out toward the opening 46 of the nozzle guard 32. Then, when the absorbing member 50 is pressed against the ink ejection surface 36*a*, the ink which is pushed out from the gap 40 is absorbed by the absorbing member 50.

Then, after a certain period of time elapses in a state in which the absorbing member 50 is pressed against the nozzle guard 32 and the ink ejection surface 36*a*, the pressing base elevating mechanism 96 contracts, and the pressing base 91 moves downward and becomes in a state in which it is separated from the absorbing member 50, as illustrated in FIG. 8C.

The ink jet printing apparatus 1 of the present embodiment is equipped with the ink removing unit 29 described above. After the ink is ejected from the ink jet head 31 at a predetermined pressure to perform the purging operation, the ink removing unit 29 performs the ink removing operation. Therefore, it is possible for the ink within the gap between the nozzle guard and the ink ejection surface to be removed.

Next, after the pressing base 91 is separated from the absorbing member 50, the winding roller 93 is rotated such that a portion of the absorbing member 50 which has absorbed the ink is conveyed rearward. At this time, the absorbing member 50 is conveyed for the length of the ink jet head 31 in the direction that the nozzle rows extend.

By the absorbing member 50 being conveyed in this manner, a new region of the absorbing member 50 which has not absorbed ink is disposed at a position that faces the ink ejection surface 36*a* of the ink jet head 31.

Accordingly, it is not necessary to replace the sheet shaped absorbing member, the frequency of replacement can be reduced, and the maintenance properties can be improved.

Here, the four ink jet heads 31 which are provided in the head unit 26 are arranged at predetermined intervals in the left to right direction. In the present embodiment, the widths of the intervals among the ink jet heads 31 are at least the width of the ink jet heads 31 in the left to right direction (a direction perpendicular to the direction in which the nozzle rows of the ink jet heads 31 extend).

Figure 9:
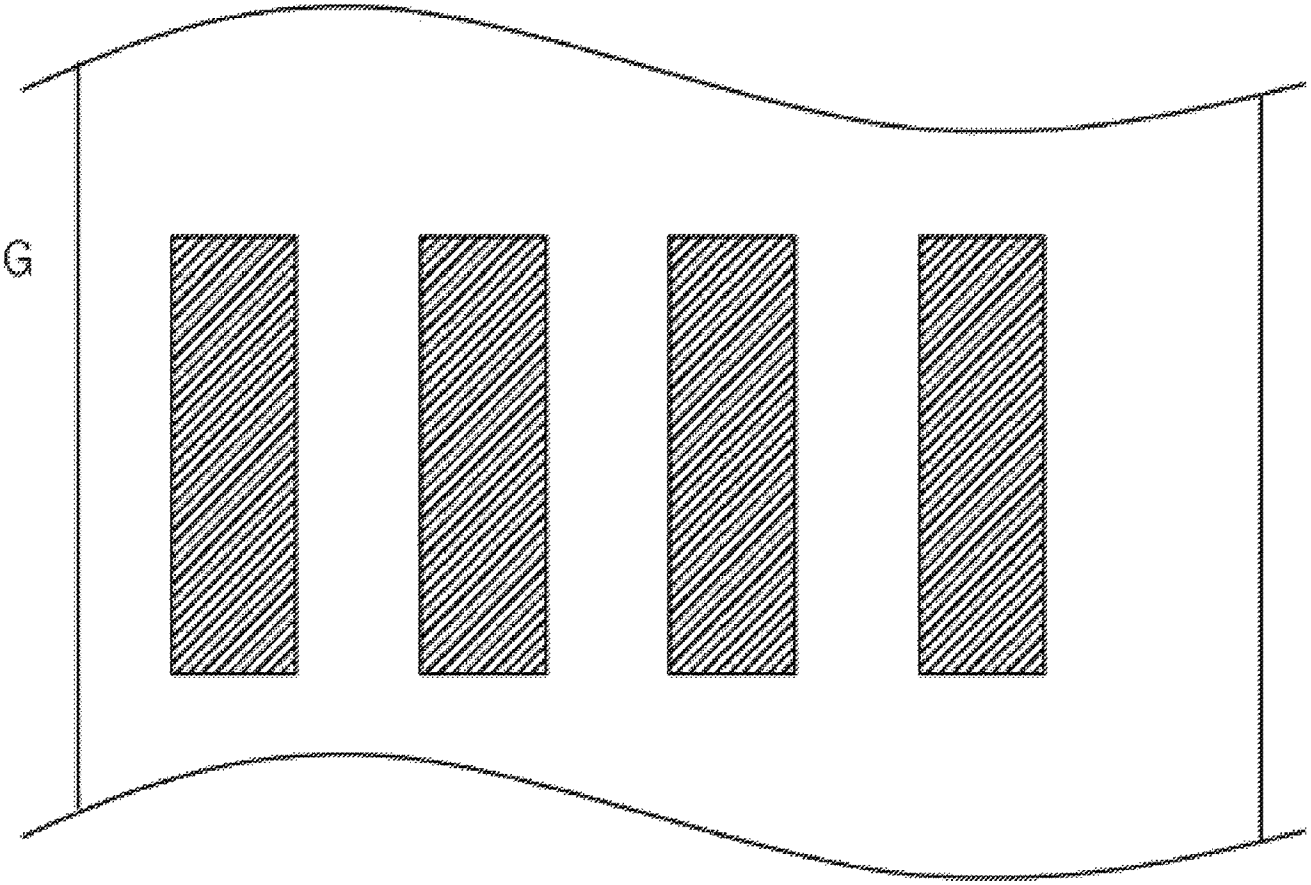
FIG. 9 is a diagram that illustrates an absorbing member following a first ink removing operation as viewed from above.

Accordingly, regions at which the absorbing member 50 absorbs the ink by a single ink removing operation which is described above are also regions among which predetermined intervals are present in the left to right direction. FIG. 9 is a diagram that illustrates an absorbing member 50 following a first ink removing operation as viewed from above. The hatched portions in FIG. 9 are the regions at which the ink is absorbed. As illustrated in FIG. 9, the regions at which the ink is absorbed are also arranged at the same intervals as the ink jet heads 31. That is, the regions of the absorbing member 50 among the regions at which the ink is absorbed have not absorbed ink, and are in the same state as an unused state.

Therefore, as illustrated in FIG. 8C, before the absorbing member 50 is conveyed backward, an absorbing member moving unit 51 (refer to FIG. 18) may cause the ink removing unit 29 to move in the left to right direction by at least the same distance as the width of the ink jet head 31. The absorbing member moving unit 51 is constituted by a known actuator. In the present embodiment, the absorbing member moving unit 51 corresponds to the moving unit of the present invention.

Figure 10:
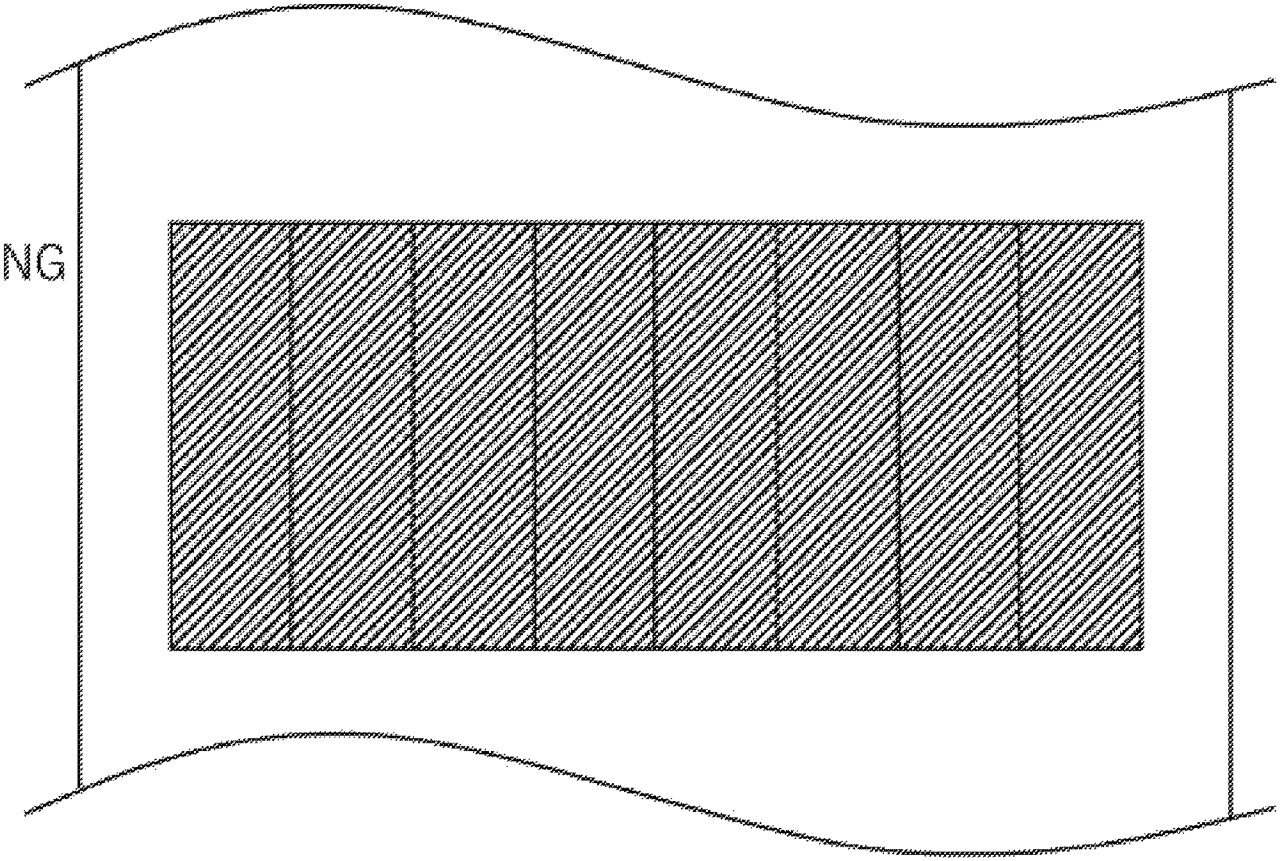
FIG. 10 is a diagram that illustrates the absorbing member following a second ink removing operation as viewed from above.

As a result, when performing a next purging operation, the ink can be absorbed at the aforementioned unused area of the absorbing member 50 as well by raising the pressing base 91 as illustrated in FIG. 8B, and it becomes possible for the absorbing member 50 to be utilized more efficiently. FIG. 10 is a diagram that illustrates the regions at which ink is absorbed by the absorbing member 50 by a second ink removing operation.

Note that in the present embodiment, the absorbing member moving unit 51 moves the ink removing unit 29. However, the head unit 26 may be relatively moved for a distance equal to the widths of the ink jet heads 31 by moving the head unit 26 or moving both the ink removing unit 29 and the head unit 26. By changing the regions at which the ink jet heads 31 are pressed against the absorbing member 50 by moving for a distance equal to the widths of the ink jet heads 31 in this manner, it becomes possible to utilize the absorbing member 50 more efficiently without gaps of unutilized portions.

Then, after the second ink removing operation is performed, the absorbing member 50 may be conveyed backward as illustrated in FIG. 8C. As a result, the unutilized regions of the absorbing member 50 can be again arranged immediately below the head unit 26, the ink removing operation can be performed twice again, and maintenance properties can be improved.

At this time, the absorbing member 50 may be utilized more efficiently without gaps of unutilized portions by conveying the absorbing member 50 for the lengths of the ink jet heads 31 in the direction in which the nozzle rows of the ink jet heads 31 extend.

Note that with respect to conveyance of the absorbing member 50 in the front to back direction, the amount of conveyance is controlled by controlling the amount of rotation of the winding motor 29*a* by a control unit 5. However due to the change in the diameter of the rolled absorbing member R accompanying utilization thereof, a desired amount of conveyance may not be achieved even if the winding motor 29*a* is rotated by a preset rotation amount.

Figure 11:
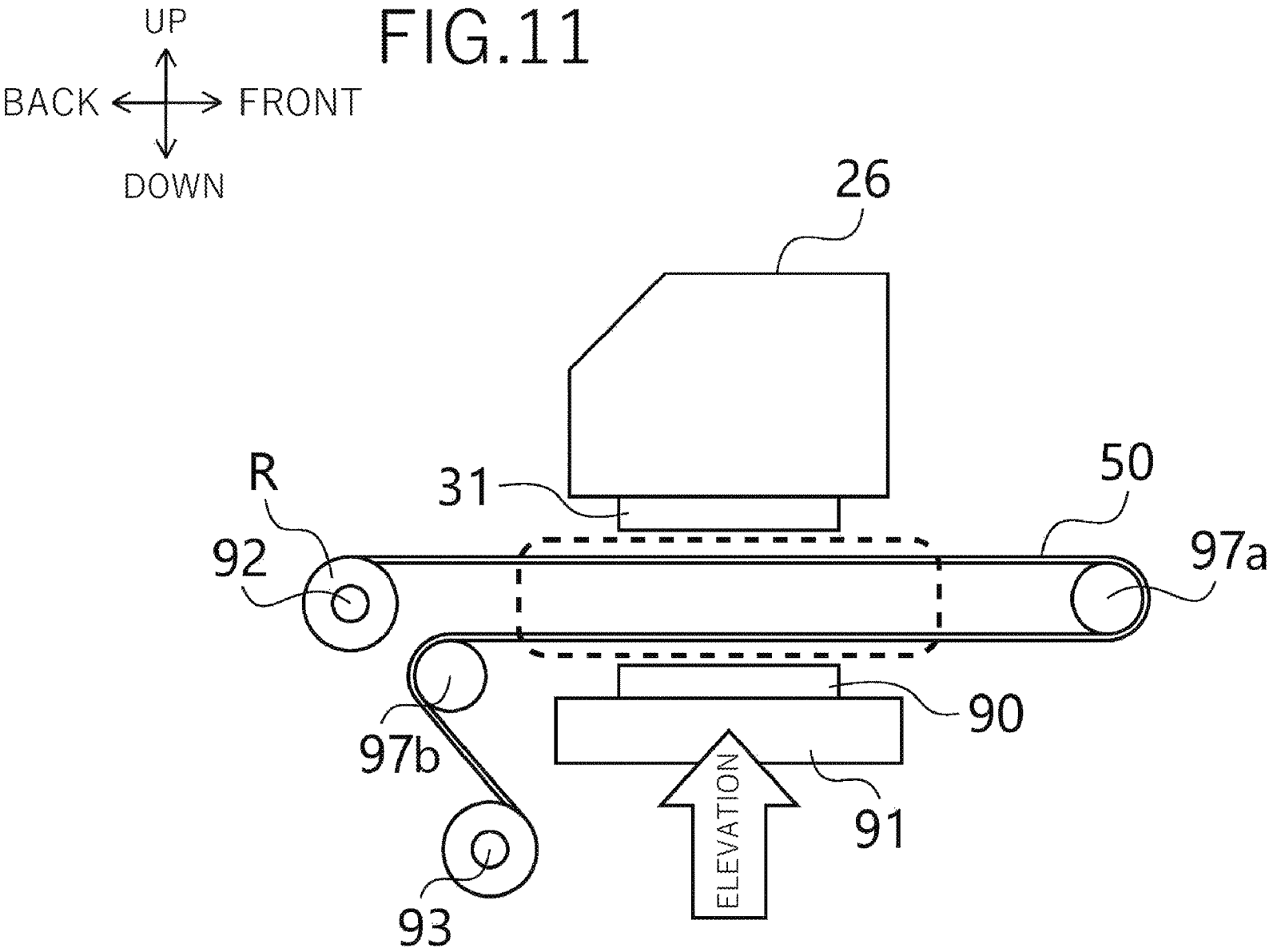
FIG. 11 is a diagram that illustrates an example of a configuration for pressing two stacked absorbing members against a nozzle guard and an ink ejection surface.
Figure 12:
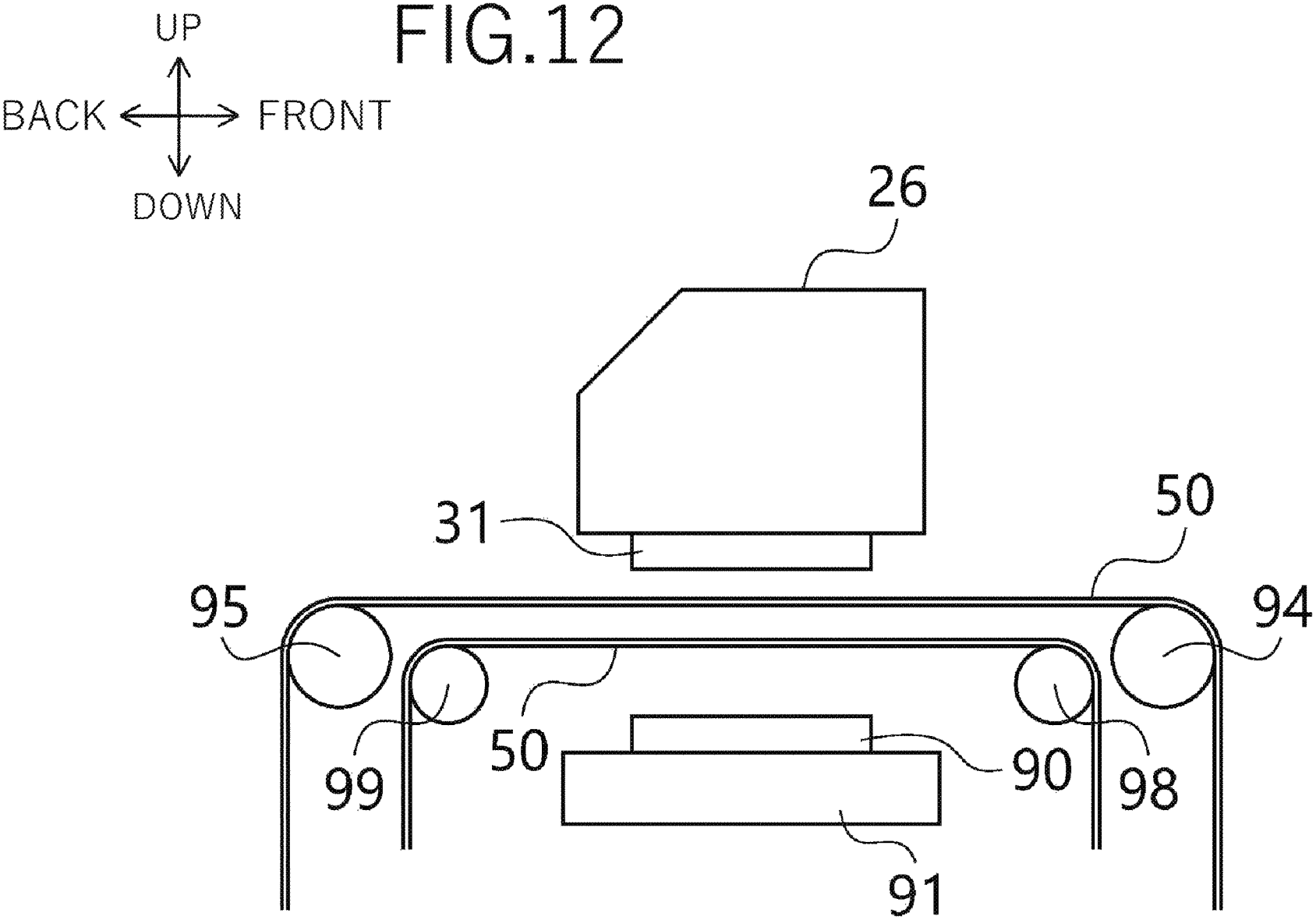
FIG. 12 is a diagram that illustrates an example of a configuration for pressing two stacked absorbing members against a nozzle guard and an ink ejection surface.

Therefore, a conveyance amount detector such as a rotary encoder may be provided in at least one of the feed side conveyance roller 94 and the winding side conveyance roller 95. Thereby, the amount of conveyance of the absorbing member 50 can be detected, and the control unit 5 may control the amount of rotation of the winding motor 29*a* based on the detected amount of conveyance to achieve a desired amount of conveyance In addition, in the present embodiment, a single absorbing member 50 which is unwound from the rolled absorbing member R is pressed against the ink jet head 31, as described above, but the present invention is not limited to such a configuration. In the case that a large amount of ink enters the gap 40 of the ink jet head 31, for example, a plurality of absorbing members 50 may be pressed against the ink jet head 31 in a stacked state. FIG. 11 and FIG. 12 are diagrams that illustrate examples of configurations in which two absorbing members 50 are pressed against the nozzle guard 32 and the ink ejection surface 36*a* in a stacked state.

In the configuration illustrated in FIG. 11, the absorbing member 50 which is unwound from the rolled absorbing member R provided on the feed roller 92 is conveyed toward the bottom of the ink jet head 31 from the rear side to the front side. The absorbing member 50 which has passed directly beneath the ink jet heads 31 is folded back to the opposite side by a first conveyance roller 97*a* and is conveyed under the ink jet heads 31 again.

The first conveyance roller 97*a* is provided at the same height as the feed roller 92, and is installed on the opposite side of the feed roller 92 with the head unit 26 interposed therebetween.

Then, the absorbing member 50 which is folded back by the first conveyance roller 97*a* again passes directly under the ink jet head 31 and is conveyed to a second conveyance roller 97*b*. The second conveyance roller 97*b* is provided obliquely below the front side of the feed roller 92.

Then, the absorbing member 50 which is transported to the second conveyance roller 97*b* is folded back to the opposite side by the second conveyance roller 97*b* and is wound by the winding roller 93. The winding roller 93 is arranged obliquely below the front side of the second conveyance roller 97*b*.

As described above, the absorbing member 50 which has passed directly below the ink jet head 31 is folded back to the opposite side by the first conveyance roller 97*a* and is conveyed such that the absorbing member 50 is conveyed directly below the ink jet heads 31 twice. If the pressing base 91 is raised in such a conveyance state of the absorbing member 50, it becomes possible to press the two absorbing members 50 against the ink jet head 31 in the range indicated by the dotted oval illustrated in FIG. 11 in a stacked state. Accordingly, even in the case that a large amount of ink enters the gap 40 of the ink jet heads 31, the two absorbing members 50 can sufficiently absorb the ink.

Next, the configuration illustrated in FIG. 12 is that in which another set of the feed roller 92, the feed side conveyance roller 94, the winding side conveyance roller 95, and the winding roller 93 of the present embodiment is provided below the head unit 26. In the configuration illustrated in FIG. 12, another set of a feed side conveyance roller 98 and a winding side conveyance roller 99 is located below the feed side conveyance roller 94 and the winding side conveyance roller 95 at positions close to the pressing base 91. Note that the feed roller 92, the winding roller 93, and another set of rollers that correspond to these rollers are not illustrated in FIG. 12.

In the configuration illustrated in FIG. 12 as well, in the case that the pressing base 91 is moved upward, the two absorbing members 50 can be pressed against the ink jet heads 31 in a stacked state. Thereby, even when a large amount of ink enters the gap 40 of the ink jet head 31, the two absorbing members 50 can sufficiently absorb the ink.

Further, the control unit 5 may switch between an operation that presses one absorbing member 50 against the nozzle guard 32 and the ink ejection surface 36*a*, and an operation that presses a plurality of absorbent members 50 against the nozzle guard 32 and the ink ejection surface 36*a* according to the amount of ink that enters the gap 40 of the ink jet heads 31. Specifically, in the case of the configuration illustrated in FIG. 12, for example, in the case that the control unit 5 performs an operation of pressing one absorbing member 50 against the nozzle guard 32 and the ink ejection surface 36*a*, the absorbing member 50 of one of the two sets of rollers may be moved in the left to right direction by a predetermined moving mechanism to retract the absorbing member 50 from directly beneath the ink jet heads.

In addition, it is preferable for the absorbing member 50 to contain a liquid which has dissolving properties with respect to dried ink. By the absorbing member 50 containing such a liquid, it will become possible to appropriately remove ink which has seeped out from the gap 40 between the ink ejection surface 36*a* and the nozzle guard 32 and has dried. It is preferable for a liquid which is the same as a cleansing solution which is utilized by the wiping unit 30 to be described later to be employed as the liquid having dissolving properties with respect to dried ink. Further, an absorbing member 50 that contains the liquid in advance may be employed, or a tank for storing the liquid may be provided, and a configuration that immerses the absorbing member 50 in the tank while the absorbing member 50 is conveyed from the feed roller 92 to the winding roller 93 may be further provided.

Figure 14:
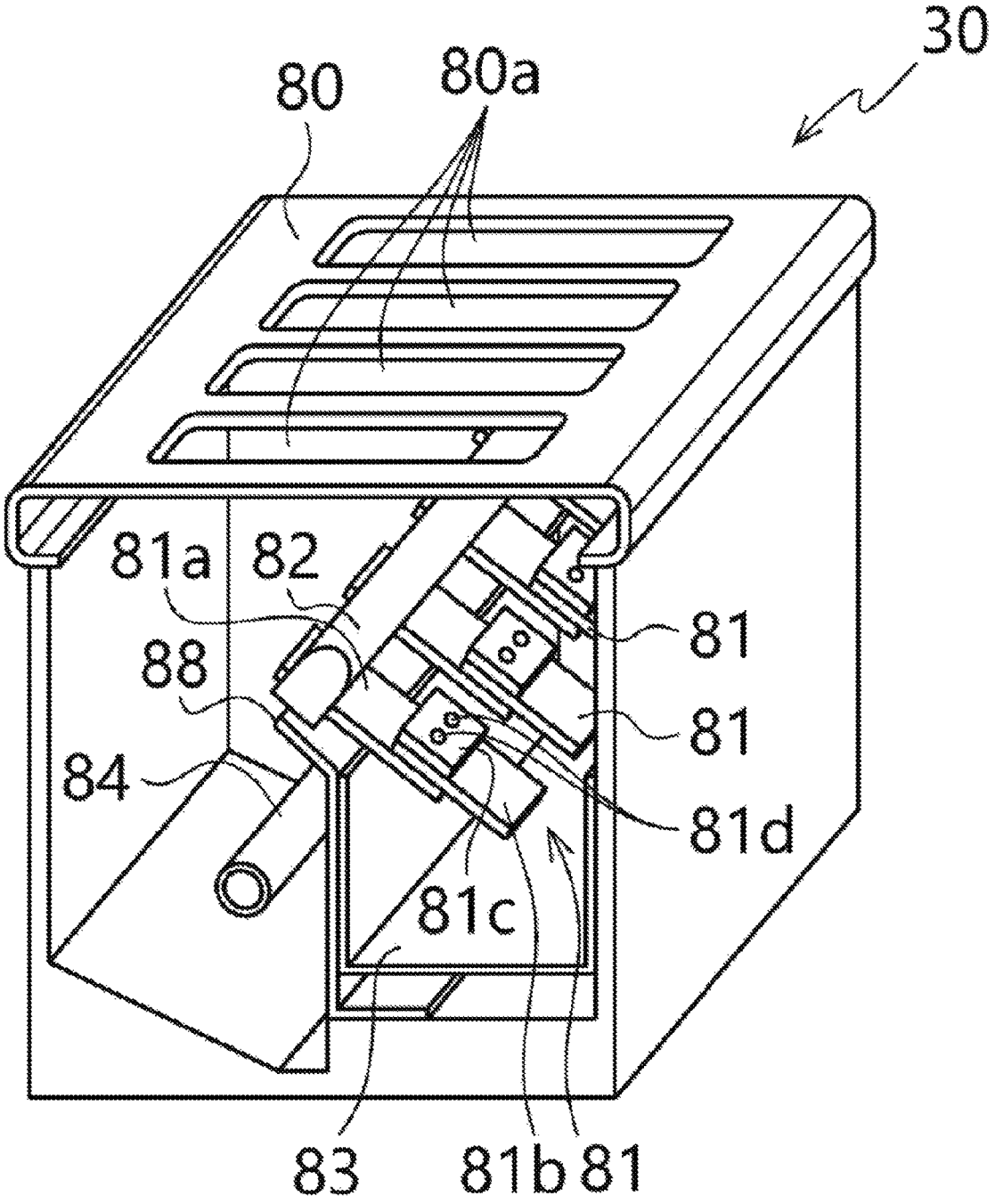
FIG. 14 is a perspective view that illustrates the state of the interior of the wiping unit in a standby state.
Figure 15:
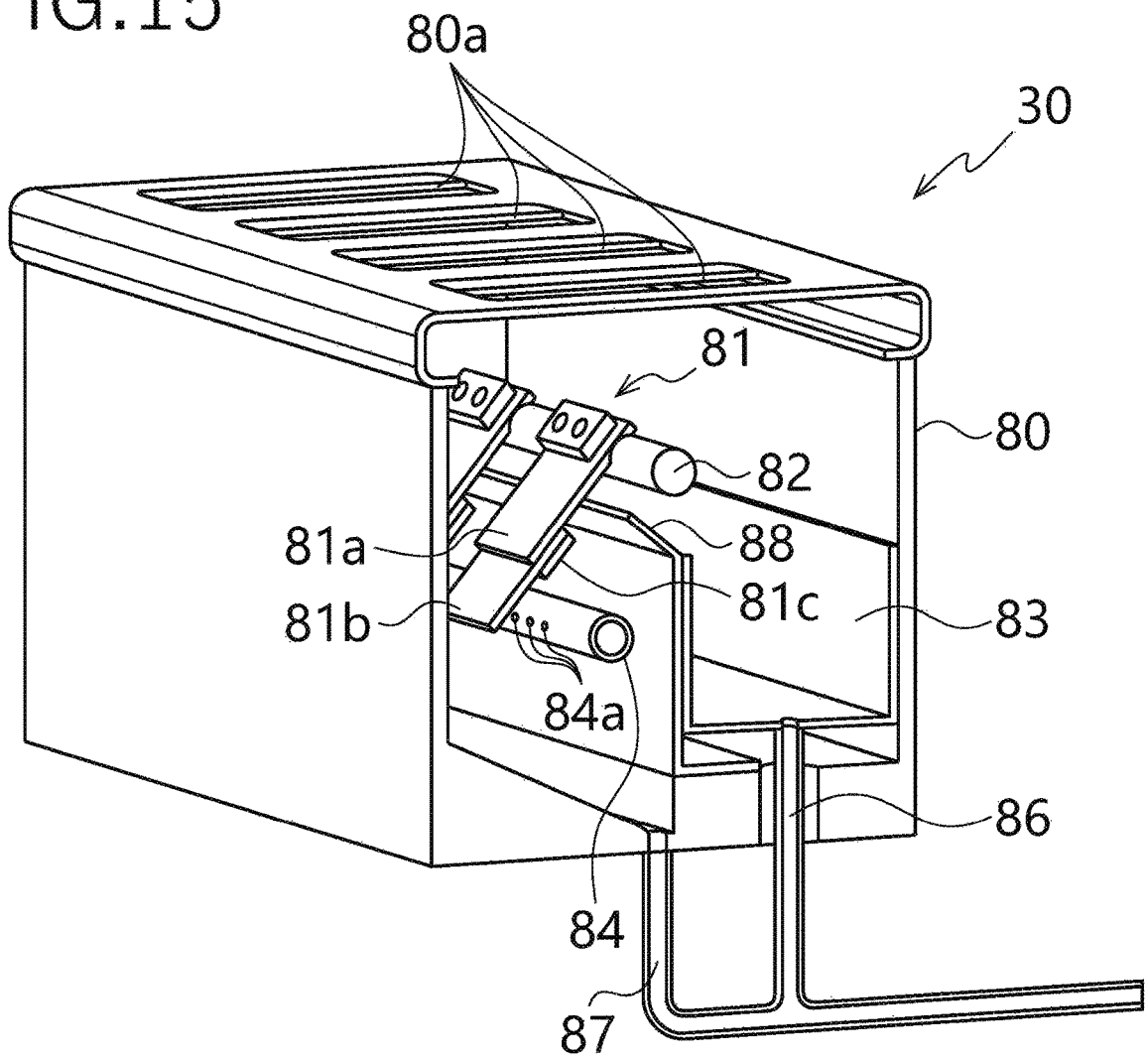
FIG. 15 is a perspective view that illustrates the state of the interior of the wiping unit during a cleansing solution spraying operation.

Returning to FIG. 2, the wiping unit 30 is installed within the interior of the housing 21 of the shuttle unit 4 at the left end portion thereof, at the left side of the ink removing unit 29 described above. FIG. 13 is a diagram that illustrates the internal configuration of the wiping unit 30, which is a cross-sectional view taken along the arrow Z-Z illustrated in FIG. 2. In addition. FIG. 14 is a perspective view that illustrates an internal state of the wiping unit 30 in a standby state to be described later, and FIG. 15 is a perspective view that illustrates an internal state of the wiping unit 30 when spraying a cleansing solution as will be described later.

The wiping unit 30 cleans the ink ejection surface 36*a* of the ink jet head 31 and the lower surface of the nozzle guard 32 by wet wiping. In the present embodiment, the wiping unit 30 corresponds to the wiping device of the present invention.

Specifically, the wiping unit 30 is equipped with a housing 80, a wiping unit 81, a rotational shaft 82, a cleansing tank 83, a shower unit 84, a cleansing tank pipe 86, and a shower unit pipe 87 as illustrated in FIG. 13.

The wiping unit 81 wipes the ink ejection surface 36*a* of the ink jet head 31 and the lower surface of the nozzle guard 32. Specifically, the wiping unit 81 is equipped with a blade supporting member 81*a*, a wiping blade 81*b*, and a blade fixing member 81*c*.

The wiping blade 81*b* is constituted by a flexible material such as rubber and is formed to have the shape of a rectangular plate. EPDM (ethylene propylene diene rubber) may be employed as the rubber, for example.

The blade supporting member 81*a* is formed by a metal. One end of the blade supporting member 81*a* is connected to the rotational shaft 82, and the other end is connected to one end of the wiping blade 81*b*.

The blade fixing member 81*c* is a member for fixing the wiping blade 81*b* to the blade supporting member 81*a*, and is formed by a rectangular metal plate. Two threaded apertures 81*d* (refer to FIG. 14) are formed in the blade fixing member 81*c*. The wiping blade 81*b* is fixed between the blade supporting member 81*a* and the blade fixing member 81*c* by passing screws through the threaded apertures 81*d* and fitting the screws into the blade supporting member 81*a*.

The wiping unit 81 is provided for each of the ink jet heads 31 of the head unit 26. In the present embodiment, the four wiping units 81 are arranged in the left to right direction at the same intervals as the intervals of the four ink jet heads 31. The wiping blade 81*b* of the wiping unit 81 has a width equal to the width of the ink jet head 31 in the left to right direction.

The rotational shaft 82 is a shaft member which is provided at a position along a direction in which the wiping blade 81*b* extends and extends in the left to right direction. The rotational shaft 82 is a shaft member which is rotated in the circumferential direction about the central axis thereof by a wiper driving unit 100 (refer to FIG. 18). One end of each of the blade supporting members 81*a* of the aforementioned four wiping units 81 is respectively connected to and supported by the rotational shaft 82. Then, by the rotational shaft 82 rotating, the blade supporting member 81*a* rotates about the supported one end, that is, the rotational shaft 82, in the direction of arrow A in FIG. 13 and a direction opposite the direction of arrow A, about the rotational shaft 82. Thereby, the wiping blade 81*b* also rotates.

Figure 16:
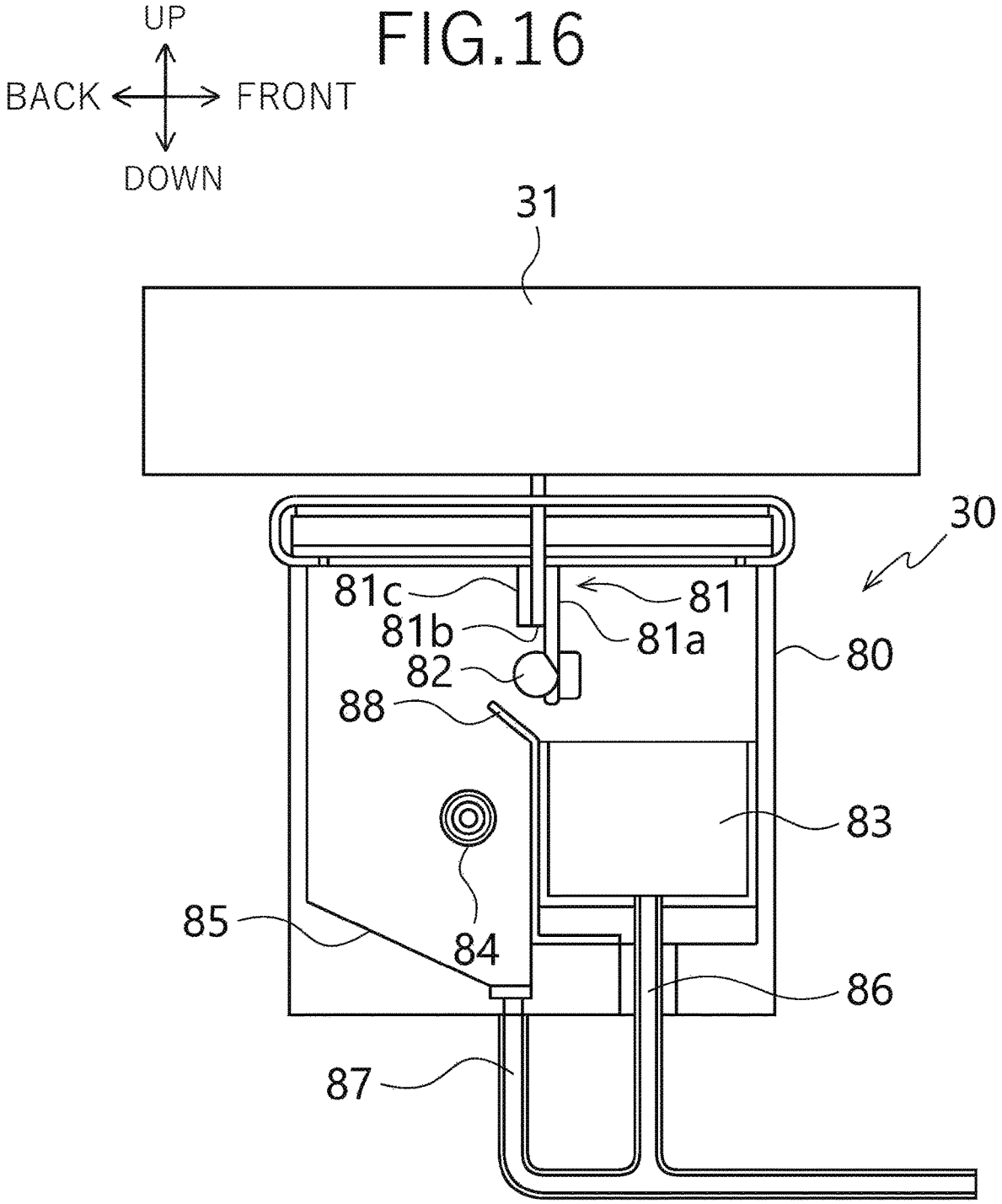
FIG. 16 is a diagram that illustrates the position of a wiping blade during wiping of the ink jet head.

FIG. 13 illustrates the position of the wiping blade 81*b* in a standby state. FIG. 16 illustrates the position of the wiping blade 81*b* during a wiping operation of the ink jet head 31. FIG. 17 illustrates the position of the wiping blade 81*b* during a cleansing solution spraying operation. The wiping blade 81*b* is configured to be rotatable from the position illustrated in FIG. 13 to the position illustrated in FIG. 17 via the position illustrated in FIG. 16, and conversely, rotatable from the position illustrated in FIG. 17 to the position illustrated in FIG. 13 via the position illustrated in FIG. 16.

The state illustrated in FIG. 13 corresponds to a state in which the wiping blade of the present invention is immersed in the cleaning tank, and the state illustrated in FIG. 16 corresponds to a state in which wiping is performed by bringing the other end of the wiping blade of the present invention into contact with the ink ejection surface, and the state illustrated in FIG. 17 corresponds to a state in which the cleansing solution is sprayed by the spraying unit. The control unit 5 causes the wiping blade to transition among the state illustrated in FIG. 13, the state illustrated in FIG. 16, and the state illustrated in FIG. 17 as described above. In addition, the rotational shaft 82 and the wiper driving unit 100 of the present embodiment correspond to the rotational driving unit of the present invention.

The wiping unit 30 of the present embodiment transition among the three states described above by rotating the wiping blade 81*b* about the rotational shaft 82 as described above. Therefore, the wiper unit 30 is capable of transitioning among three states with a more compact configuration, and the apparatus can be miniaturized.

Note that in the present embodiment, a more compact configuration is realized by rotating the wiping blade 81*b* in the manner described above. However, the configuration for transitioning among the above three states is not limited to that in which the wiping blade 81*b* is rotated by the rotational shaft 82. Other configurations that combine horizontal movement, vertical movement and rotational movement of the wiping blade 81*b* may be adopted to transition among the three states described above.

The cleansing tank 83 is installed within a space in the front half of the housing 80 of the wiping unit 30. The cleansing tank 83 is a rectangular parallelepiped container that stores the cleansing solution. The cleansing tank 83 is arranged such that the wiping blade 81*b* is immersed in the cleansing solution in the case that the wiping blade 81*b* is at the position which is illustrated in FIG. 13 and FIG. 14 (the position that extends obliquely toward the front side than below in the vertical direction). The cleansing tank pipe 86 is connected to the bottom of the cleansing tank 83, and a configuration by which discharge of the cleansing solution is enabled is constituted by the cleansing tank pipe 86.

In addition, although not illustrated in the drawings, a cleansing solution supply pipe for supplying new cleansing solution into the cleansing tank 83 is connected to the cleansing tank 83. In the case that the cleansing solution which is stored in the cleansing tank 83 has decreased due to utilization or volatilization, the control unit 5 may automatically supply new cleansing solution to the cleansing tank 83 via the cleansing solution supply pipe, for example. Regarding control of the amount of the cleansing solution, for example, the amount of the cleansing which is stored in the cleansing tank 83 may be detected by a liquid amount detection unit such as an optical sensor, and the control unit 5 may control the amount of the cleansing solution based on the detection signal such that it is maintained at a desired amount.

The shower unit 84 is provided in a space within the rear half of the housing 80 of the wiping unit 30. The shower unit 84 sprays the cleansing solution when the wiping blade 81*b* is at the position illustrated in FIG. 15 and FIG. 17 (a position that extends obliquely rearward than below in the vertical direction). The shower unit 84 is arranged such that the sprayed cleansing solution is sprayed onto the lower surface of the wiping blade 81*b*. In the present embodiment, the shower unit 84 corresponds to the spraying unit of the present invention.

The shower unit 84 is constituted by a pipe shaped member that extends in the left to right direction, and a plurality of spray ports 84*a* are formed along the length direction of the pipe shaped member as illustrated in FIG. 15. The cleansing solution is supplied to the interior of the pipe shaped member of the shower unit 84 at a predetermined pressure, whereby the cleansing solution is sprayed in the form of a shower from the spray ports 84*a*. The cleansing solution which is sprayed from the spray ports 84*a* is sprayed on the lower surface of the wiping blade 81*b* at the position illustrated in FIG. 15 and FIG. 17, whereby the lower surface of the wiping blade 8*b* is cleansed.

In addition, an inclined surface 85 having a high rear side and a low front side is formed at the bottom of the rear half of the housing 80. As a result, the cleansing solution which has been sprayed onto the wiping blade 81*b* from the shower unit 84 and then drops flows along the inclined surface 85 and reaches the center of the entire bottom of the housing 80. The shower unit pipe 87 is connected to the center of the entirety of the bottom of the housing 80. The cleansing solution that flows to the center via the inclined surface 85 is discharged to the exterior from the shower unit pipe 87.

In addition, a plate member 88 is provided on the front side of the shower unit 84 along the outer wall surface on the rear side of the cleansing tank 83. The plate member 88 extends above the outer wall surface on the rear side of the cleansing tank 83, and the extending portion is formed so as to be inclined toward the shower unit 84 rather than vertically upward. As a result, the cleansing solution which is sprayed from the shower unit 84 onto the lower surface of the wiping blade 81*b* and splashes from the lower surface of the wiping blade 81*b* can be prevented from splashing into the periphery by colliding with the lower surface of the extended portion of the plate member 88. The cleansing solution which has collided with the plate member 88 flows downward along the plate member 88 and is discharged from the shower unit pipe 87 described above, which is provided immediately under the plate member 88.

Note that the cleansing pipe 86 and the shower pipe 87 are both constituted by elastic tubes, and are connected to the downstream side with a sufficient length such that they can track the movement of the wiping unit 30.

In addition, four rectangular apertures 80*a* that extend in the front to back direction are formed on the upper surface of the housing 80 of the wiping unit 30, as illustrated in FIGS. 14 and 15. The four apertures 80*a* are formed at positions that correspond to the four wiping blades 81*b*. When the wiping blade 8*b* moves to the wiping position illustrated in FIG. 16, each wiping blade 81*b* passes through the aperture 80*a* that corresponds respectively thereto. The leading end portion of each wiping blade 81*b* (the end portion not connected to the blade supporting member 81*a*) is configured to protrude from the upper surface of the housing 80, as illustrated in FIG. 16.

Next, the wiping operation which is performed by the wiping unit 30 of the present embodiment will be described.

First, when the shuttle unit 4 is arranged at the standby position, the wiping unit 30 stands by at a position in front of the ink jet head 31 in the state illustrated in FIG. 13 (standby position).

When the head unit 26 moves above the wiping unit 30, the ink jet heads 31 are lowered by the head elevating motor 25, and the distance between the wiping unit 30 and each of the ink jet heads 31 gets closed to a predetermined distance.

Then, as illustrated in FIG. 13, the wiping blade 81*b* which is immersed in the cleansing solution within the cleansing tank 83 is rotated in the direction of arrow A by the wiper driving unit 100 and moved to the spraying position illustrated in FIG. 17.

Then, the cleansing solution is sprayed from the shower unit 84 toward the lower surface of the wiping blade 81*b*. Thereby, fresh cleansing solution can be caused to adhere to the wiping blade 81*b*. Next, the wiper blade 81*b* is rotated by the wiper driving unit 100 in the direction opposite the direction of arrow A. and moves to a state where it is erected in the vertical direction. In this state, a wiper moving unit 101 (refer to FIG. 21) moves the wiping unit 30 toward the front side such that the leading end of each wiping blade 81*b* reaches the position of the front end of the ink jet head 31 corresponding thereto. The wiper moving unit 101 is constituted by a known actuator.

Then, the wiper moving unit 101 moves the wiping unit 30 to the wiping position, at which the leading end portion of each wiping blade 81*b* is pressed against the nozzle guard 32 and the ink ejection surface 36*a* of each ink jet head 31 and is elastically deformed, as illustrated in FIG. 16.

Then, in a state in which the leading end portion of each wiping blade 81*b* is pressed against each ink jet head, the wiping unit 30 is moved rearward by the wiper moving unit 101 (refer to FIG. 18). Thereby, wiping of the lower surface of the nozzle guard 32 and the ink ejection surface 36*a* of each of the ink jet heads 31 is performed.

Note that although the wiping unit 30 is moved in the front to back direction in the present embodiment, the present invention is not limited to such a configuration, and the head unit 26 may be moved in the front to back direction. Alternatively, both the wiping unit 30 and the head unit 26 may be moved in opposite directions in the front to back direction.

Then, after wiping is completed by the leading end of each of the wiping blades 81*b* reaching the back end of each of the ink jet heads 31, the head unit 26 is moved upward by the head elevating motor 25 for a predetermined distance, and the wiping unit 30 is separated from each of the ink jet heads 31 by the predetermined distance. Note that in the present embodiment, the head unit 26 is moved up and down when performing the wiping operation. Alternatively, a configuration in which the wiping unit 30 is moved up and down to adjust the distance between the wiping blades 81*b* and the ink jet heads 31 may be adopted.

Then, the wiping blade 81*b* rotates to the position illustrated in FIG. 17, and the cleansing solution is sprayed from the shower unit 84 toward the lower surface of the wiping blade 81*b* again. As a result, contaminants which had become adhered to the lower surface of the wiping blade 81*b* due to the wiping operation described above can be washed away.

Next, after the wiping blade 81*b* is washed by the shower unit 84, the wiping blade 81*b* rotates in the opposite direction and moves to the position illustrated in FIG. 13 again. The above is the series of steps of the wiping operation which is performed by the wiping unit 30 of the present embodiment.

According to the wiping unit 30 of the present embodiment, first, the cleansing solution is sprayed onto the wiping blade 81*b* from the shower unit 84 before wiping is performed. Therefore, wiping can be performed by the wiping blade 81*b* which has been cleansed with fresh uncontaminated cleansing solution.

After wiping is performed as well, the cleansing solution is sprayed onto the wiping blade 81*b* from the shower unit 84. Therefore, contaminants which became adhered to the wiping blade 8*b* due to wiping can be appropriately removed. In addition, the wiping blade 81*b* can be immersed in the cleansing tank 83 in a clean state by the spraying of the cleansing solution after wiping. Therefore, contamination of the cleansing solution within the cleansing tank 83 can be prevented.

That is, the wiping unit 30 of the present embodiment is capable of wiping the ink jet head 31 with the wiping blade 81*b* which is always wetted with an uncontaminated cleansing solution.

Note that in the present embodiment, the cleansing solution is sprayed by the shower unit 84 before and after the wiping of the ink jet head 31 as described above. The pressure when spraying before wiping and the pressure when spraying after wiping may be changed. For example, the spraying pressure after wiping is preferably relatively high because it is necessary to remove contaminants which have become adhered to the wiping blade 81*b* due to wiping. Then, consumption of the cleansing solution can be suppressed by setting the spraying pressure before wiping relatively low.

A liquid that dissolves adhered substances (including ink components and flakes and powder on the surface of the print medium) which are adhered to the ink ejection surface 36*a* and the surface of the nozzle guard 32 is employed as the cleansing solution. It is preferable for an aqueous solvent containing water and a surfactant to be employed as the cleansing solution. Examples of the surfactant include anionic surfactants such as sodium fatty acid, sodium alkylbenzenesulfonate, sodium alkylsulfonate, sodium α-olefin sulfonate, sodium alkylsulfate, sodium alkyl ether sulfate, sodium α-sulfo fatty acid ester, sodium alkylphosphate ester; cationic surfactants such as alkyltrimethylammonium and dialkyldimethylammonium; nonionic surfactants such as sorbitan fatty acid ester, polyoxyethylene sorbitan fatty acid ester, sucrose fatty acid ester, polyoxyethylene alkyl ether, polyoxyethylene alkyl phenyl ether, and amphoteric surfactants such as alkyl amino fatty acid sodium, alkyl betaine, and alkylamine oxide. Further, polymeric surfactants, silicone surfactants, fluorine surfactants, acetylene glycol surfactants, etc. may be employed. Among these, it is preferable for polyoxyethylene alkyl ether to be employed, and it is more preferable for the HLB value thereof to be 11 to 17, the number of carbon atoms of the alkyl group to be within a range from 8 to 15, and the number of moles of ethylene oxide added to be within a range from 6 to 25.

Further, it is preferable for the cleansing liquid to further contain a thickener. A water soluble polymeric thickener or a clay mineral based thickener may be employed as the thickener. Natural polymers, semisynthetic polymers, synthetic polymers may be employed as the water soluble polymeric thickener. Examples of natural polymers include natural plant polymers such as gum arabic, carrageenan, guar gum, locust bean gum, pectin, tragacanth gum, cornstarch, konjak mannan, agar; natural microbial polymers such as pullulan, xanthan gum and dextrin; and natural animal polymers such as gelatin, casein, glue. Examples of semisynthetic polymers include cellulose semisynthetic polymers such as ethylcellulose, carboxymethylcellulose, hydroxyethylcellulose, hydroxypropylcellulose, methylcellulose, and hydroxypropylmethylcellulose; starch series polymers such as hydroxyethylstarch, carboxymethylstarch sodium, and cyclodextrin; alginic acid based semisynthetic polymers such as sodium alginate and propylene glycol alginate; and sodium hyaluronate. Examples of synthetic polymers include vinyl synthetic polymers such as polyvinyl pyrrolidone, polyvinyl alcohol, polyvinyl methyl ether, poly N-vinyl acetamide, and polyacrylamide; polyethylene oxide, polyethylene imine, and polyurethane. Examples of the clay mineral based thickener include smectite clay minerals such as montmorillonite, hectorite, and saponite. Among these, it is preferable for hydroxypropyl methyl cellulose to be employed.

In addition to the above components, the cleansing liquid may optionally contain a water soluble organic solvent, a pH adjusting agent, an antioxidant, a preservative, etc., as appropriate. It is preferable for the viscosity of the cleansing solution to be within a range from 5 to 200 mPa-s at 23° C., and more preferably a range from 10 to 100 mPa s.

Note that the cleansing solution which is stored in the cleansing tank 83 and the cleansing solution which is sprayed from the shower unit 84 do not necessarily have to be the same. For example, the cleansing solution which is stored in the cleansing tank 83 is preferably a cleansing solution having a lower volatility than the cleansing solution which is sprayed from the shower unit 84. This can prevent the cleansing solution which is stored in the cleansing tank 83 from being volatilized and reduced. A cleansing solution that contains an acetylene glycol series surfactant, a moisturizing agent such as glycerin, a water soluble solvent, and water may be employed as such a cleaning solution, either alone or in combination.

In addition, it is preferable for the cleansing solution which is sprayed from the shower unit 84 to be a cleansing solution which has a higher cleansing ability than the cleansing solution which is stored in the cleansing tank 83. Because the wiping blade 81*b* is immersed in the cleansing tank 83 for a certain period of time, the wiping blade 81*b* can be sufficiently cleaned even if the cleaning solution within the cleansing tank 83 does not have such a high cleansing ability. However, the cleansing solution which is employed by the shower unit 84 is sprayed onto the wiping blade 81*b*, and it does not remain on the surface of the wiping blade 81*b* for along time. Therefore, by employing a cleansing solution which has a high cleansing ability as the cleansing solution employed by the shower unit 84, it is possible to sufficiently perform cleansing only by spraying the wiping blade 81*b*. A cleansing solution that contains an acetylene glycol series surfactant, a moisturizing agent such as glycerin, a water soluble solvent, and water may be employed as such a cleansing solution, either alone or in combination.

Note that although only one shower unit 84 is provided in the present embodiment, two shower units 84 may be provided such that they face both surfaces of the wiping blade 81*b*, for example, and the cleansing solution may be sprayed on both surfaces of the wiping blade 81*b*.

Further, in the present embodiment, the cleansing solution is sprayed by the shower unit 84 before and after the wiping of the ink jet head 31 as described above. However, the time required for a series of wiping operations becomes long in this case, and it takes time before a printing operation can be initiated.

Therefore, the cleansing solution may not be sprayed by the shower unit 84 before wiping the ink jet head 31, and the cleansing solution may be sprayed by the shower unit 84 only after wiping. Adopting such a configuration can improve productivity.

In addition, the cleansing solution is sprayed by the shower unit 84 after the wiping of the ink jet head 31 to remove the ink that flows down from the ink jet head 31 and adheres to the wiping blade 81*b* due to the wiping in the present embodiment. There are some cases in which the ink which is adhered to the wiping blade 81*b* cannot be removed only by the cleansing solution spraying operation.

Further, when spraying the cleansing solution from the shower unit 84 toward the wiping blade 81*b*, if the cleansing solution is sprayed in a spreading manner, there is a possibility that the contaminated solution following cleansing may be scattered to the periphery. Therefore, it is preferable for the range in which the cleansing solution spreads to be limited. However, in the case that the cleansing solution is sprayed in such a narrow range, the range in which the cleansing solution is sprayed onto the wiping blade 81*b* will become narrow. Therefore, if ink is adhered outside such a range, it cannot be removed.

In the case that the ink which is adhered to the wiping blade 8*b* cannot be removed as described above, the wiping blade 81*b* in a contaminated state will be immersed in the cleansing tank 83, and the cleansing solution within the cleansing tank 83 will be contaminated with the ink. Particularly in the case that ink remains on the plurality of wiping blades 81*b*, inks of different colors will be mixed in the cleansing solution.

In the case that the wiping blade 81*b* is immersed in the cleansing tank 83 which is contaminated by ink in this manner, the wiping blade 8*b* to which the contaminated cleansing solution adheres comes into contact with the ink jet head 31 during wiping. As a result, the ink jet head. 31 is not wiped, but contaminated. Particularly in the case that the cleansing solution spraying operation by the shower unit 84 prior to wiping is omitted as described above, the contamination becomes significant.

Therefore, in order to more reliably remove the ink which became adhered to the wiping blade 81*b* due to wiping, the control unit 5 may control the wiper driving unit 100 during the operation of spraying the cleansing solution onto the wiping blade 81*b* after the wiping is performed to cause the wiping blade 81*b* to reciprocally rotate. Note that reciprocal rotation means rotating in a forward direction and a reverse direction. For example, the direction of arrow A illustrated in FIG. 13 may be designated as the forward direction. FIG. 18 is a diagram that illustrates the manner in which the wiping blade 81*b* is reciprocally rotated as described above. In the example illustrated in FIG. 18, the wiping blade 81*b* is rotated in the forward and reverse directions within the range of arrow B, with the position of the wiping blade 81*b* indicated by the solid line as the center. The wiping blade 81*b* periodically and reciprocally rotates a plurality of times within the range of arrow B.

By reciprocally rotating the wiping blade 81*b* in this manner, the ink which has adhered to the wiping blade 81*b* can be caused to drop in a short amount of time by utilizing centrifugal force. In addition, since the range in which the cleansing solution is sprayed by the shower unit 84 can be widened by the reciprocal rotation of the wiping blade 81*b*, the range of cleansing on the wiping blade 81*b* can be widened. Particularly, the wiping blade 81*b* of the present embodiment is connected to the blade supporting member 81*a* by the blade fixing member 81*c*, but ink which is adhered to the blade fixing member 81*c* may remain. By expanding the range of cleansing as described above, it is possible to remove even the ink which is adhered to the blade fixing member 81*c*.

As a result, the ink which is adhered to the wiping blade 81*b* can be removed more positively, and therefore the cleansing solution within the cleansing tank 83 can always be kept in an uncontaminated state.

Note that in the case that the wiping blade 8*b* is reciprocally rotated as described above, it is preferable to reciprocally rotate the wiping blade 81*b* below a horizontal plane that contains the rotational shaft 82, as illustrated in FIG. 18. By adopting such a configuration, the weight of the ink itself which is adhered to the wiping blade 81*b* can be utilized together with centrifugal force. Therefore, the ink can be caused to drop more efficiently.

As a range in which the wiping blade 81*b* is reciprocally rotated, it is preferable for a position at which the wiping blade 81*b* is moved to its lowest position (the position of the lower dotted line illustrated in FIG. 18) to be designated as a position inclined by 15° with respect to the vertical downward direction, and a position at which the wiping blade 81*b* is moved to its uppermost position (the position of the upper dotted line illustrated in FIG. 18) to be designated as a position inclined by 45° with respect to the vertically downward direction, for example. In this case, the range in which the wiping blade 81*b* is reciprocally rotated, that is, the range of arrow B, is 30°.

In addition, in the case that the wiping blade 8*b* is reciprocally rotated as described above, it is preferable to continue the reciprocal rotation even after the cleansing solution is sprayed by the shower unit 84. Adopting such a configuration makes it possible for the ink which is adhered to the wiping blade 81*b* to be caused to drop more positively.

Further, in the case that the wiping blade 81*b* is reciprocally rotated after the cleansing solution is sprayed by the shower unit 84 as described above, it is preferable for the range of reciprocal rotation following the spraying of the cleansing solution to be wider than the range of reciprocal rotation during the spraying of the cleansing solution. Adopting such a configuration makes it possible for ink that remains on the wiping blade 81*b* after the spraying of the cleansing solution to be caused to drop more positively.

Still further, it is preferable for the rotational speed when the wiping blade 81*b* is reciprocally rotated to be higher than the rotational speed during the series of wiping operations described above. Thereby, more centrifugal force can be applied to the wiping blade 81*b*.

In addition, in the present embodiment, the blade fixing member 81*c* is employed to connect the wiping blade 81*b* to the blade supporting member 81*a* as described above. There are cases in which ink and a contaminated cleansing solution enters a gap between the blade fixing member 81*c* and the wiping blade 81*b* and cannot be removed merely by the spraying of the cleansing solution by the shower unit 84. Ink which has entered the gap between the blade fixing member 81*c* and the wiping blade 81*b* flows out into the cleansing solution when the wiping blade 81*b* is immersed in the cleansing tank 83, and contaminates the cleansing solution.

Figure 19:
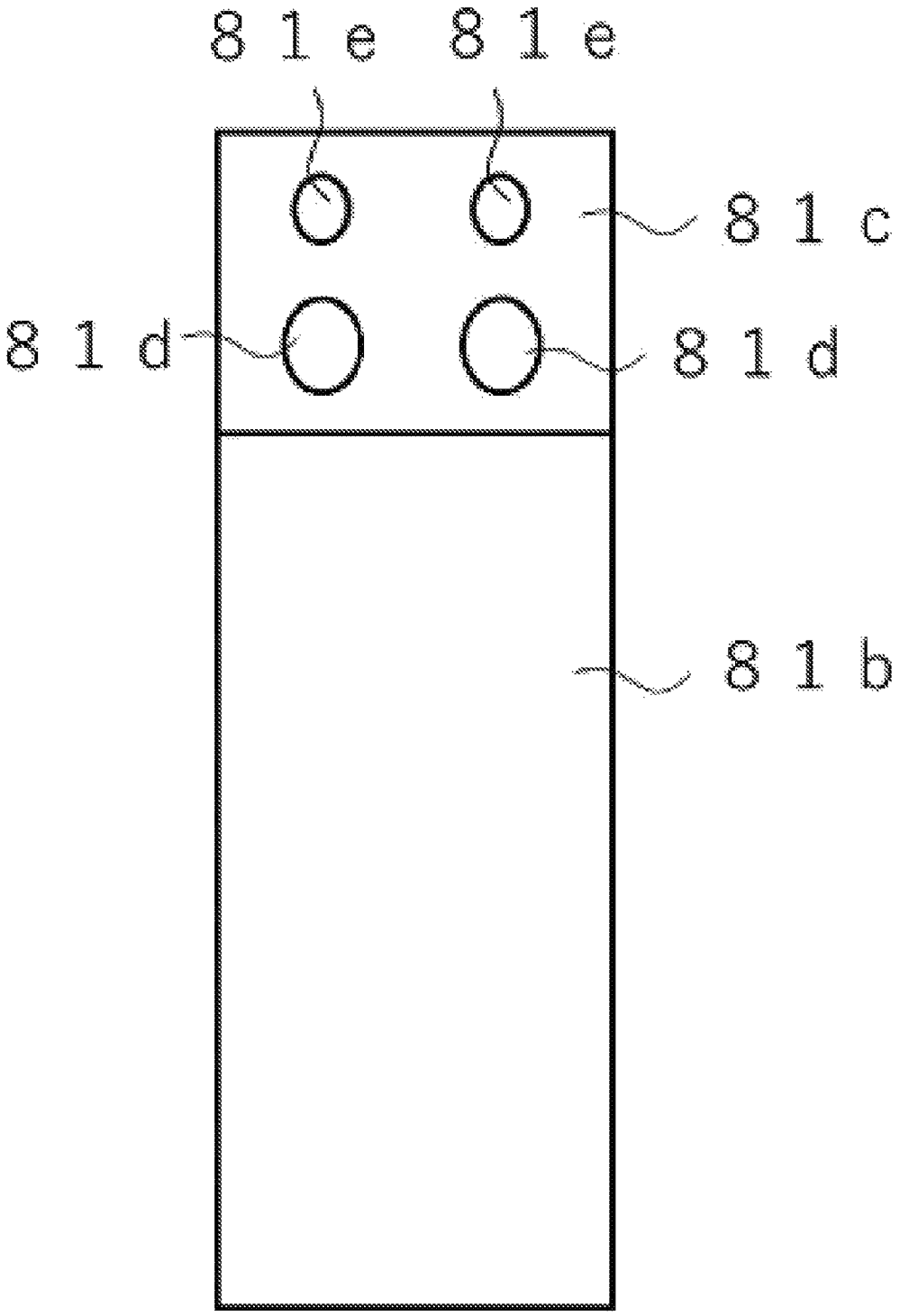
FIG. 19 is a diagram that illustrates another embodiment of a blade fixing member.

Therefore, in order to remove the ink or the like which has entered the gap described above, a penetrating aperture 81*e* which is different from the threaded aperture 81*d* may be formed in the blade fixing member 81*c* as illustrated in FIG. 19, for example. By forming the penetrating aperture 81*e* in the blade fixing member 81*c* in this manner, the cleansing solution which is sprayed by the shower unit 84 can be caused to flow into the gap between the blade fixing member 81*c* and the wiping blade 81*b* through the penetrating aperture 81*e*. Thereby, the ink or the like which has entered the gap can be caused to flow out onto the wiping blade 81*b* and removed.

Figure 20:
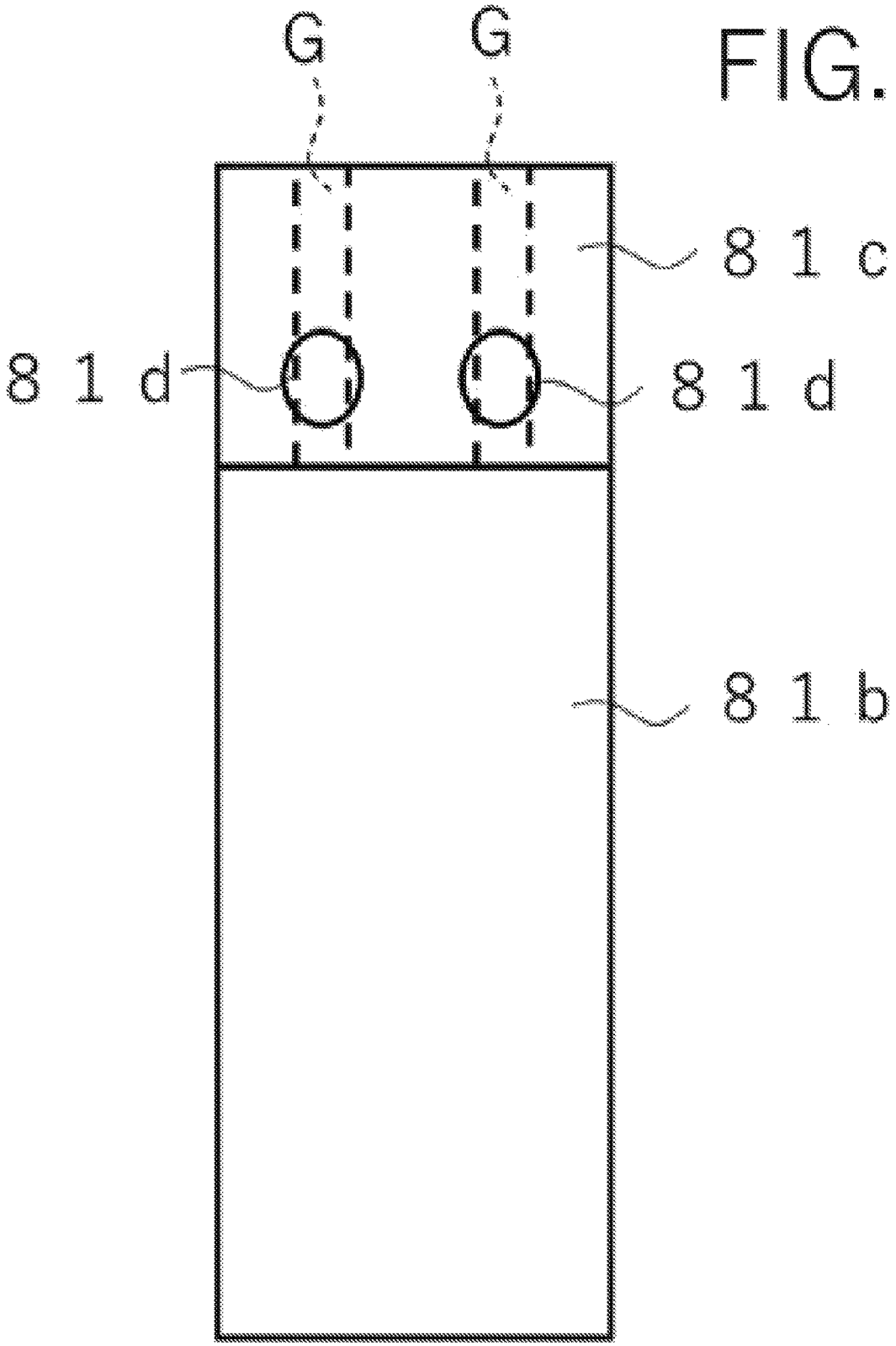
FIG. 20 is a diagram that illustrates another embodiment of the blade fixing member.

In addition, the configuration in which the ink or the like which has entered the gap between the blade fixing member 81*c* and the wiping blade 8*b* is caused to flow out onto the wiping blade 8*b* is not limited to the penetrating aperture 81*e* described above. A groove G that extends in the longitudinal direction of the wiping blade 81*b* may be formed on the surface of the side that contacts the wiping blade 81*b* as illustrated in FIG. 20, for example. The groove G is formed from the upper end surface to the lower end surface of the blade fixing member 81*c*. By forming the groove G in this manner, the cleansing solution which is sprayed by the shower unit 84 can be caused to flow into the groove G, whereby ink or the like which has entered the gap between the blade fixing member 81*c* and the wiping blade 81*b* can be caused to flow out onto the wiping blade 81*b*. Note that the groove G may be formed not only the blade fixing member 81*c* but a groove may be formed in the wiping blade 81*b* at a position that faces the groove G.

Figure 21:
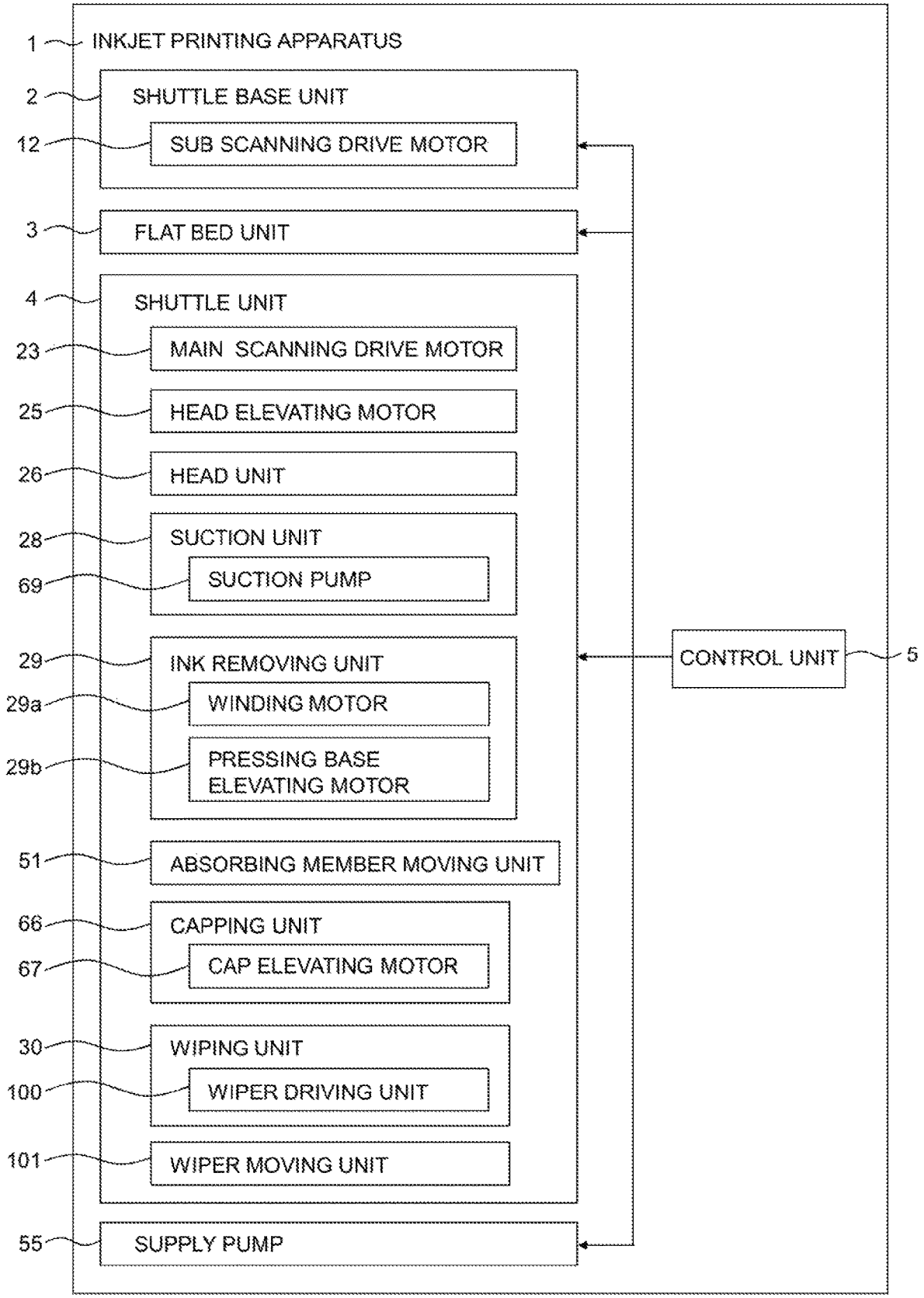
FIG. 21 is a block diagram that illustrates a control system of the ink jet printing apparatus illustrated in FIG. 1.

FIG. 21 is a block diagram that illustrates a control system of the ink jet printing apparatus 1 of the present embodiment. The ink jet printing apparatus 1 is equipped with the control unit 5 that controls the entire apparatus. The control unit 5 is equipped with a CPU (Central Processing Unit), a semiconductor memory, a hard disk, etc. The control unit 5 executes a program which is stored in advance in a storage medium such as a semiconductor memory or a hard disk, and operates an electric circuit to control each of the components illustrated in FIG. 21.

Next, a printing operation which is performed by the ink jet printing apparatus 1 of the present embodiment will be described.

When the ink jet printing apparatus 1 is in a standby state prior to a printing operation being initiated, the shuttle unit 4 is arranged at the standby position. The standby position of the shuttle unit 4 is the position of the shuttle unit 4 which is denoted by the solid line in FIG. 1, and is at the rear end of the gantry unit 11 of the shuttle base unit 2.

When a print job is input, the control unit 5 controls the sub scanning drive motor 12 to move the shuttle unit 4 from the standby position to a print process start position. The print process start position of the shuttle unit 4 is the position of the shuttle unit 4 denoted by the two dot chain line in FIG. 1, and is at the front end portion of the gantry unit 11 of the shuttle base unit 2. Note that a print medium 15 is placed on the medium placement surface 3*a* of the flat bed unit 3 prior to the input of the print job.

Next, while moving the head unit 26 in the main scanning direction by controlling the main scanning drive motor 23, the control unit 5 controls the ink jet heads 31 based on the input print job to control the ink ejection outlets 37 such that printing for one pass is performed. Next, the control unit 5 controls the sub scanning drive motor 12 to move the shuttle unit 4 backward to the printing position for a next pass. The control unit 5 forms an image on the print medium 15 by alternately repeating the printing for one pass and the movement of the shuttle unit 4.

When printing of one sheet is completed, the control unit 5 controls the sub scanning drive motor 12 to return the shuttle unit 4 to the standby position. Then, the printing operation is completed.

Here, in the present embodiment, the absorbing member 50 that absorbs ink is pressed against the opening 46 of the nozzle guard 32 and the ink ejection surface 36*a* of the ink jet head 31 as a method of removing ink which has entered the gap 40 between the ink ejection surface 36*a* of the ink jet head 31 and the nozzle guard 32.

Even if the ink within the gap 40 can be removed by pressing the absorbing member 50 in this manner to an extent that there is no problem in ink ejection, components such as resin contained in the ink remain on the ink ejection surface (nozzle plate). As a result, the water repelling properties of the ink ejection surface may deteriorate.

In addition, although it is possible to remove the ink within the gap 40 by pressing the absorbing member 50, it has been found that the ink ejection surface 36*a* becomes likely to dry if only this process is administered.

As a result, due to the deterioration in the water repelling properties of the ink ejection surface described above, foreign matter such as ink mist and paper dust become likely to adhere to the ink ejection surface 36*a*. The foreign matter becomes fixed onto the ink ejection surface 36*a* due to drying, and ink ejection failure occurs. In addition, due to the reduced water repelling properties of the ink ejection surface 36*a*, ejection failures such as deviances in the ejection direction of the ink and non-ejection occur.

Therefore, in the ink jet printing apparatus 1 according to the present embodiment, in addition to removing the ink within the gap 40 between the nozzle guard 32 and the ink ejection surface 36*a*, a cleaning operation that prevents deterioration in the water repelling properties and drying of the ink ejection surface 36*a* is performed Hereinafter, the cleaning operation of the ink jet printing apparatus 1 according to the present embodiment will be described with reference to FIG. 22A~22C and FIG. 23A~23B. The cleaning operation of the present embodiment is an operation that removes the ink which has entered the gap 40 between the nozzle guard 32 and the ink ejection surface 36*a*, forms a meniscus is formed at the ink ejection outlet 37 of each nozzle, and further prevents the water repelling properties of the nozzle plate 36 from deteriorating and the nozzles from drying.

The cleaning operation is performed when the shuttle unit 4 is arranged at the standby position. At this time, the head unit 26 in the shuttle unit 4 is located at the standby position which is illustrated in FIG. 2.

Figure 22A:
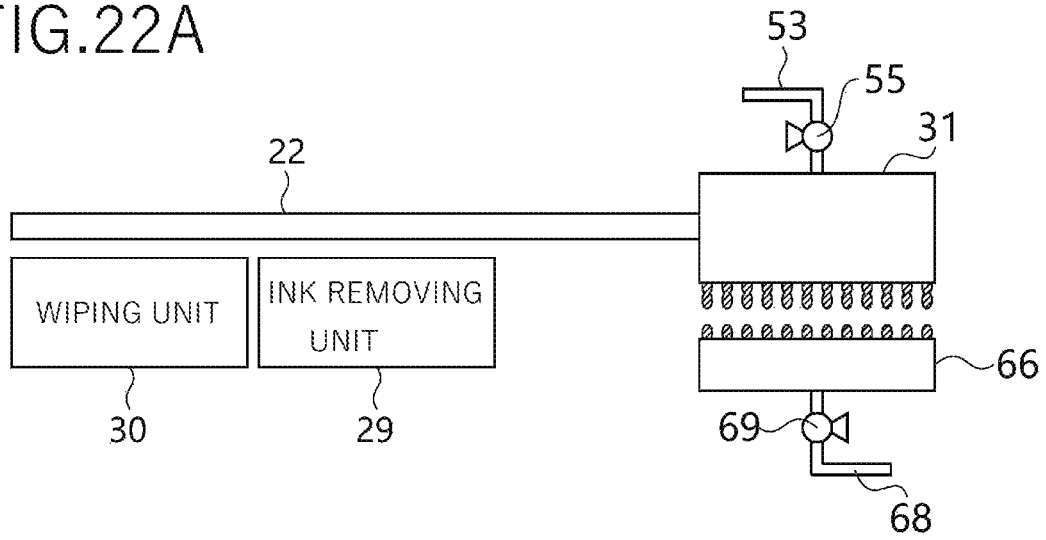
FIG. 22A is a diagram for explaining a cleaning operation of the ink jet printing apparatus illustrated in FIG. 1.

First, as illustrated in FIG. 22A, the supply pump 55 is controlled by the control unit 5 in a state in which the ink jet head 31 is arranged above the capping unit 66, and ink is ejected at a predetermined pressure to perform a purging operation. With respect to the purging operation, the amount of ink which was purged through each of the nozzles is set to approximately 4.8 mg/sec, for example.

During this purging operation, the opening 46 of the nozzle guard 32 of the ink jet head 31 may be hermetically sealed by the cap 71 of the capping unit 66, or may be opened as illustrated in FIG. 22A. However, it is preferable for the opening 46 of the nozzle guard 32 to be hermetically sealed by the cap 71. By hermetically sealing the opening 46 of the nozzle guard 32 in this manner, entry of debris such as dust into the cap 71 or contamination of the periphery of the cap 71 by ink can be prevented.

The ink which is ejected from the ink jet head 31 by the purging operation described above is received in the capping unit 66, and is suctioned and collected from the capping unit 66 by the control unit 5 controlling the suction pump 69. By this purging operation, the ink ejection outlets 37 of the ink jet head 31 become in a state in which ink droplets D are attached thereto, as illustrated in FIG. 22A.

Figure 22B:
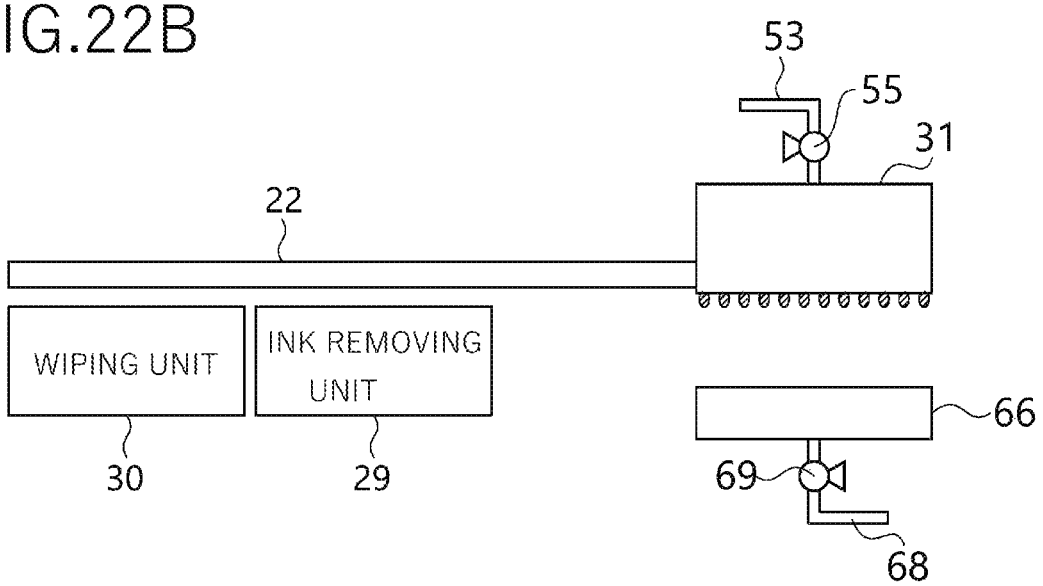
FIG. 22B is a diagram for explaining a cleaning operation of the ink jet printing apparatus illustrated in FIG. 1.
Figure 22C:
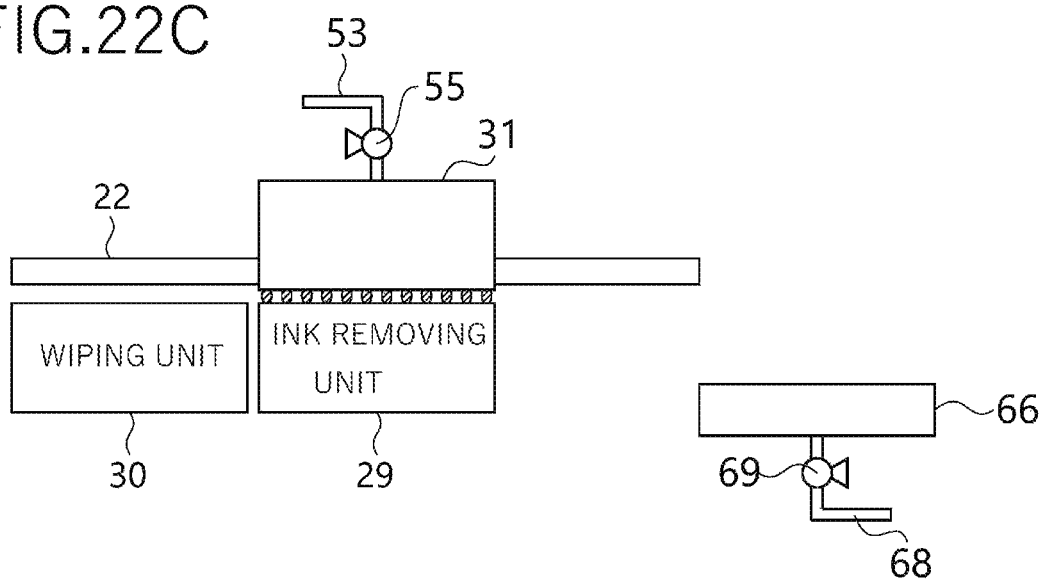
FIG. 22C is a diagram for explaining a cleaning operation of the ink jet printing apparatus illustrated in FIG. 1.

Next, the control unit 5 stands by in the state illustrated in FIG. 22B until the pressure applied by the supply pump 55 weakens and the amount of ink which is ejected from the nozzles is stabilized. Specifically, it is preferable for the amount of standby time to be within a range from 20 to 30 seconds in the case that the purging operation is conducted for three seconds at a pressure that causes each of the nozzles to eject 4.8 mg/sec of ink. Note that in this standby state, the opening 46 of the nozzle guard 32 of the ink jet head 31 may be hermetically sealed by the cap 71 of the capping unit 66, or may be opened as illustrated in FIG. 22B. In addition, the amount of standby time may be changed according to the pressure of the supply pump 55 during the purging operation.

By providing the standby time in this manner, contamination of the interior of the ink jet printing apparatus 1 by the ink which is adhered to the ink ejection outlet 37 of the ink jet head 31 dropping due to the purging operation when the head unit 26 is moved thereafter, for example, can be prevented. In addition, by changing the amount of standby time according to the pressure of the supply pump 55 during the purging operation as described above, it becomes possible to wait until the pressure of the supply pump 55 positively weakens.

Next, after the standby time described above has elapsed, the ink jet head 31 (head unit 26) is moved and arranged above the pressing base 91 of the ink removing unit 29. Then, the ink removing unit 29 performs the ink removing operation described above. By this ink removing operation, the ink which has entered the gap 40 between the nozzle guard 32 and the ink ejection surface 36*a* can be removed, and a meniscus can be formed at the ink ejection outlet 37 of each nozzle. The formation of these meniscuses enables favorable ink ejection.

Figure 23A:
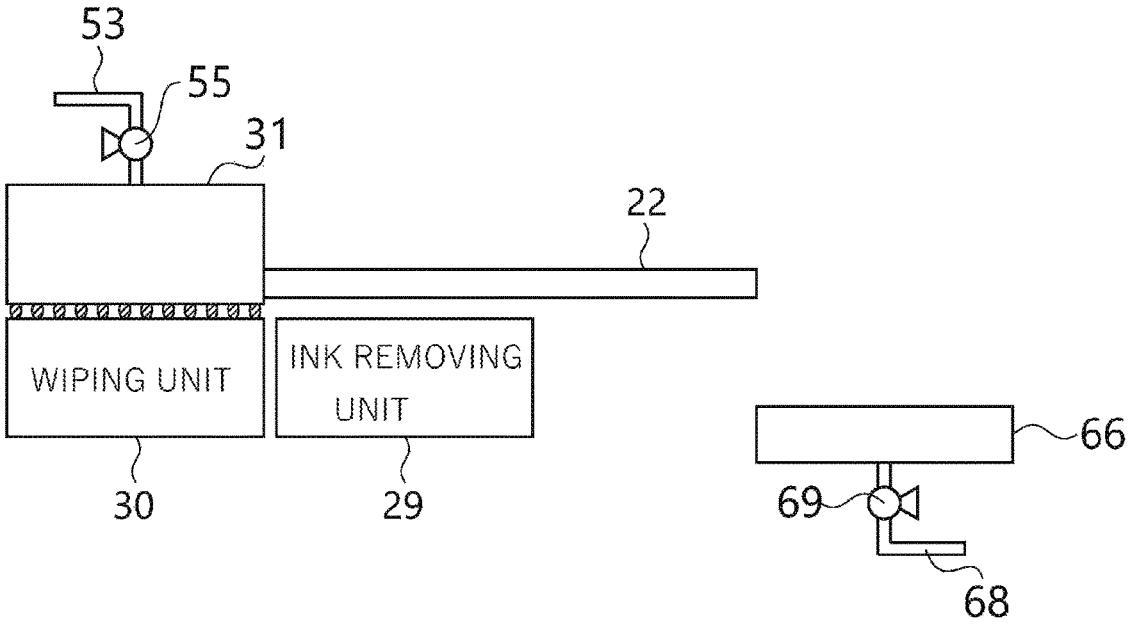
FIG. 23A is a diagram for explaining the cleaning operation of the ink jet printing apparatus illustrated in FIG. 1.]

Then, after the ink removing operation is completed, the ink jet head 31 (head unit 26) is moved and is arranged above the wiping unit 30 as illustrated in FIG. 23A. Then, the wiping operation is performed by the wiping unit 30. As a result, it is possible to remove the contaminants which are adhered to the bottom surface of the nozzle guard 32 of the ink jet head 31 and the ink ejection surface 36*a*. Further, by performing the wiping operation with the cleansing solution, components such as resin (components that reduce water repelling properties) which are contained in the ink which is adhered to the ink ejection surface 36*a* can be removed, such that the water repelling properties of the ink ejection surface 36*a* can be restored. Further, it is possible to prevent the nozzle from being dried by wet wiping with the cleansing solution.

Figure 23B:
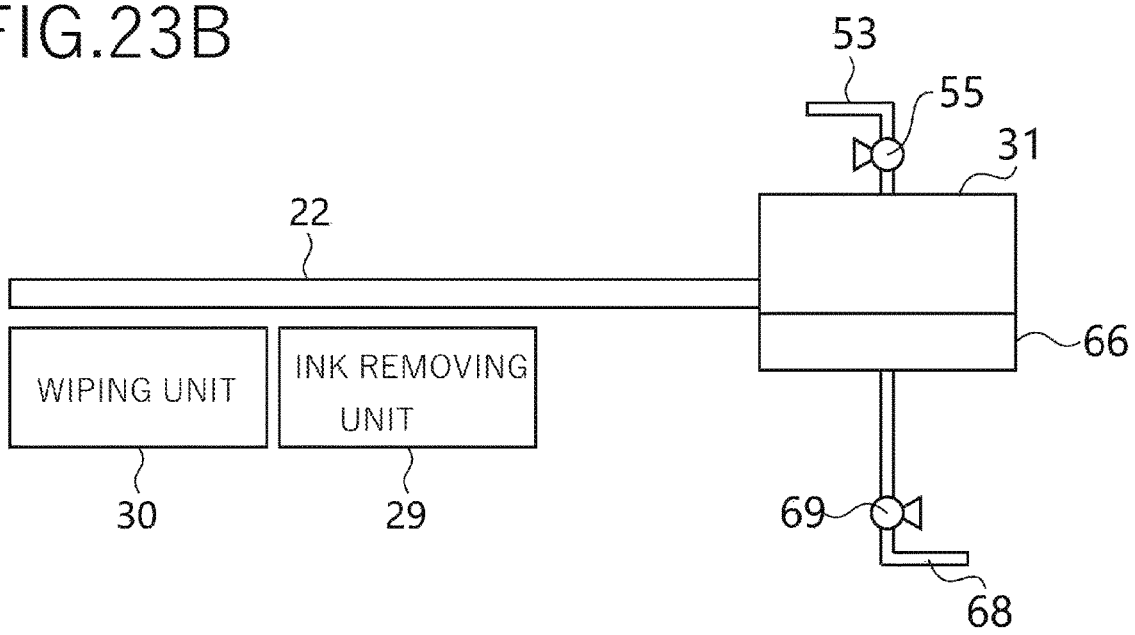
FIG. 23B is a diagram for explaining the cleaning operation of the ink jet printing apparatus illustrated in FIG. 1.

Then, after the wiping operation is completed, the ink jet head 31 (head unit 26) is moved and is arranged above the capping unit 66. Next, the capping unit 66 rises, comes into contact with the ink jet head 31, and the opening 46 of the nozzle guard 32 of the ink jet head 31 becomes in a hermetically sealed state, as illustrated in FIG. 23B. The above is the description of the cleaning operation of the present embodiment.

According to the cleaning operation of the ink jet printing apparatus 1 of the present embodiment, the ink is ejected from the ink jet head 31 at a predetermined pressure to perform the purging operation, the ink removing operation is performed, and then the wiping operation is performed. Therefore, the ink within the gap 40 between the nozzle guard 32 and the ink ejection surface 36*a* can be removed, the water repelling properties of the ink ejection surface 36*a* can be prevented from deteriorating and drying of the ink ejection surface 36*a* can also be prevented.

In the case that a printing process is performed after the cleaning operation described above, the capping unit 66 moves down, the head elevating motor 25 moves the head unit 26 up to a predetermined position, and then moves in the left to right direction along the main scanning drive guide 22, to perform the printing process.

Note that the control unit 5 may control the supply pump 55 as necessary to perform a spitting step in which a minute amount of ink is ejected from the ink jet head 31 following the cleaning operation described above and prior to performing the printing process. The spitting process is an operation that ejects a minute amount of ink ejecting from the ink jet head 31, and the ink may be ejected 1000 times per second by operating the ink jet head 31 at 5 kHz, for example. In addition, it is preferable for this spitting process to be performed in a state where the opening 46 of the nozzle guard 32 of the ink jet head 31 is hermetically sealed by the capping unit 66, as illustrated in FIG. 23B.

In addition, the cleaning operation may be performed automatically immediately prior to the printing process being initiated, or may be performed in response to an instruction input by a user. Further, the cleaning operation may be performed after every preset period or after every preset number of printed sheets.

Further, in the cleaning operation of the embodiment described above, the ink removing operation is performed after the purging operation is performed. However, the present invention is not limited to such a configuration. The purging operation and the ink removing operation may overlap each other to a certain degree.

Still further, in the cleaning operation of the embodiment described above, the wiping operation is performed by the wiping unit 30 after the ink removing operation is performed by the ink removing unit 29. However, in the case that a print job is that which performs a printing process for a large number of sheets, and the cleaning operation is performed during the printing process, only the wiping operation by the wiping unit 30 may be performed without performing the ink removing operation.

In addition, in the ink jet printing apparatus 1 of the embodiment described above, a wiping unit 30 equipped with the shower unit 84 is employed. However, the wiping unit is not limited to that having such a configuration, and a wiping unit of a configuration in which wiping is performed only by a wiping blade which is immersed in the cleansing tank, and spraying of the cleansing solution by the shower unit 84 is not performed may be employed.

Here, the ink removing operation described above is an operation that removes the ink that has entered the gap 40 between the nozzle guard 32 and the ink ejection surface 36*a*, and forms a meniscus at the ink ejection outlet 37 of each of the nozzles.

In the ink removing operation, it is desirable for the absorbency and the surface roughness of the absorbing member 50 as well as the pressing pressure and the amount of time that the absorbing member 50 is pressed against the ink jet head 31 by the pressing base 91 to be set appropriately, in order to favorably remove the ink within the gap 40 and to maintain the meniscus formed at each of the nozzles.

Specifically, in the case that the absorbency of the absorbing member 50 is low, it is not possible to appropriately remove the ink within the gap 40 of the nozzle guard 32. Further, in the case that the fibers on the surface of the absorbing member 50 are fluffed, there may be cases in which the fibers enter the ink discharge outlets 37 when the absorbing member 50 is pressed against the ink jet head 31 and break the meniscuses therein.

In addition, the greater the pressing pressure, the ink within the gap 40 of the nozzle guard 32 can be pressed outward to the exterior of the gap 40 and can be easily absorbed by the absorbing member 50. However, if the pressing pressure is excessively large, there may be cases in which the absorbing member 50 is pressed excessively strongly against the ink ejection outlets 37 and the meniscuses therein are broken, resulting in ink ejection failure.

Figure 24:
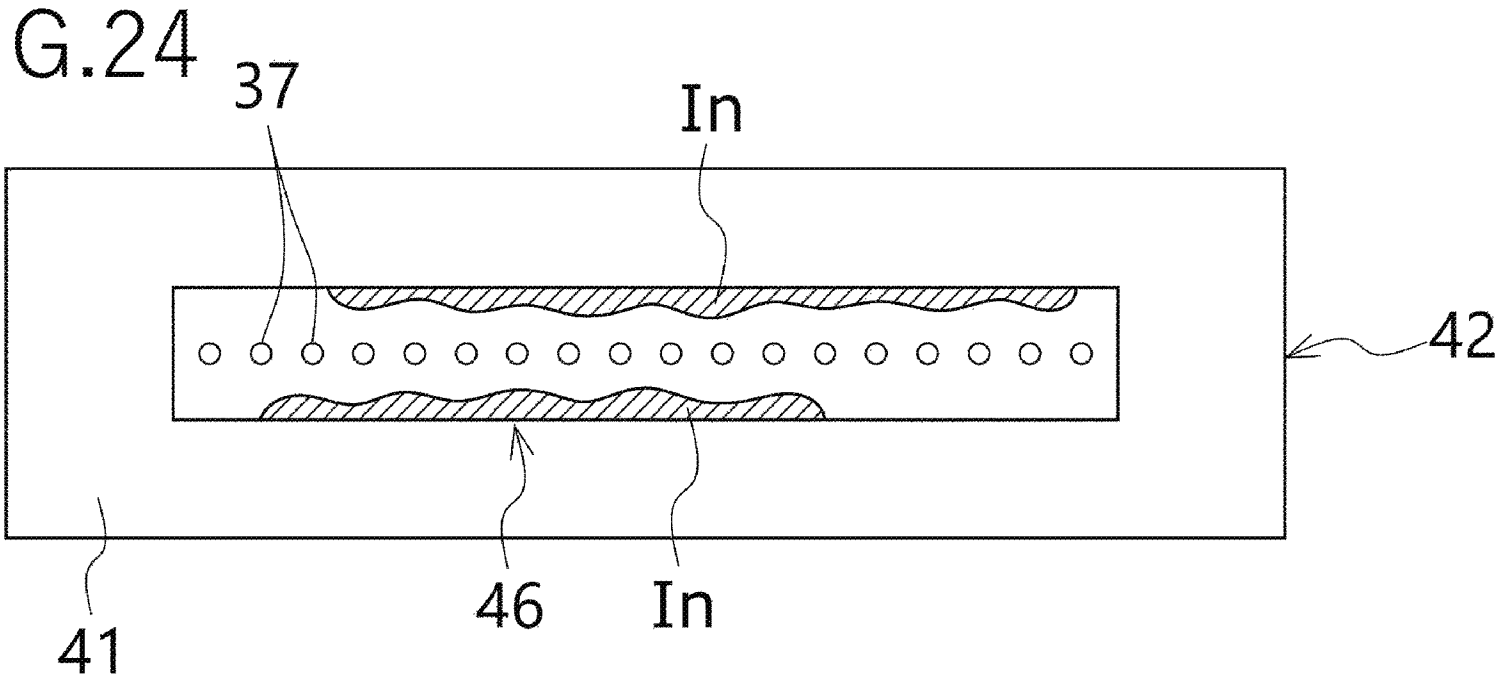
FIG. 24 is a diagram that illustrates an example of the state of ink which seeps out from a gap of the nozzle guard due to the absorbing member being pressed against the nozzle guard.

Further, there may be cases in which the ink that seeps out from the gap 40 of the nozzle guard 32 due to the pressing of the absorbing member 50 reaches the ink ejection outlet 37 before being absorbed by the absorbing member 50 and blocks the ink ejection outlet 37, resulting in ink ejection failure. FIG. 24 is a diagram that illustrates an example of the state of the ink In that seeps out from the gap 40 of the nozzle guard 32 by the pressing of the absorbing member 50.

Still further, in the case that the pressing time is excessively short, it is not possible to sufficiently absorb the ink that seeps out from the gap 40. In the case that the pressing time is excessively long, there may be cases in which the meniscuses which are formed in the ink ejection outlets 37 will be broken.

Taking these factors into consideration, it is preferable for an absorbing member having an absorbency of 10 mm/5 min or greater and 80 mm/5 min or less and a surface roughness Rz of 410 μm or less to be employed as the absorbing member 50.

In addition, it is preferable for the absorbing member 50 to be pressed against the ink jet head 31 with a pressing pressure of 10 kPa or greater and 80 kPa or less for an amount of time 7 seconds or greater and 60 seconds or less.

Note that the bases for setting the absorbency and the surface roughness Rz of the absorbing member 50 as well as the numerical values of the pressing pressure and the pressing time of the absorbing member 50 described above will be shown by Examples and Comparative Examples, which will be described later. By setting the absorbency and surface roughness Rz of the absorbing member 50 as well as the pressing pressure and pressing time of the absorbing member 50 to those described above, meniscuses can be formed more appropriately, and favorable ink ejection can be performed.

Further, it is preferable for the absorbing member 50 to be formed by fibers which are thicker than the diameter of the nozzles in order to prevent the fibers of the absorbing member 50 from breaking the meniscuses which are formed in the ink discharge ports 37 as described above. By adopting such a configuration, it will become possible to prevent the meniscuses from being broken due to the fibers of the absorbing member 50 entering the ink ejection outlets 37.

The thicknesses of the fibers of the absorbing member 50 are measured by observing the upper surface of the absorbing member 50 with an optical microscope "AZ-100M" by NIKON, and measuring the distance between two points with a measuring tool. Specifically, fibers that protrude from the upper surface of the compressed and flattened absorbing member 50 are designated as targets of measurement, two points that yield the largest diameter are specified, and the distance therebetween is measured. Then, the average value of the measurement results of ten fibers is designated as the thickness of the fibers of the absorbing member 50 as referred to here.

In addition, it is preferable for the lengths of the fiber on the surface of the absorbing member 50 to be shorter than the distance from the ink ejection surface 36*a* of the nozzles to the surface 32*a* of the nozzle guard (the surface that faces the ink ejection surface 36*a*; refer to FIG. 4). By adopting such a configuration, it will become possible to prevent the fibers of the absorbing member 50 from entering the ink ejection outlets 37, and it will become possible to prevent the meniscuses which are formed at the ink ejection outlets 37 from being broken.

The lengths of the fiber on the surface of the absorbing member 50 are measured by observing the side end face of the absorbing member 50 with an optical microscope "AZ-100M" by NIKON, and measuring the distance between two points with a measuring tool. Specifically, fibers that protrude from the upper surface of the compressed and flattened absorbing member 50 are designated as targets of measurement, the two ends of protruding portions of the fibers are specified, and the distance therebetween is measured. The average value of the measurement results of ten fibers is designated as the length of the fibers on the surface of the absorbing member 50 as referred to here.

In addition, it is preferable for the intervals of the fibers on the surface of the absorbing member 50 to be wider than the arrangement pitch of the nozzles (the intervals among adjacent nozzles). By adopting such a configuration, it will become possible to prevent the fibers of the absorbing member 50 from entering the ink ejection outlets 37, and it will become possible to suppress breakage of the meniscuses which are formed in each of the ink ejection outlets 37.

The intervals among the fibers on the surface of the absorbing member 50 are measured by observing the upper surface of the absorbing member 50 with an optical microscope "AZ-100M" manufactured by NIKON, and by measuring the distance between two points with a measuring tool. Specifically, compressed and flattened fibers that protrude from the upper surface of the absorbing member 50 are designated as targets of measurement. The distances between pairs of adjacent fibers are measured. Then, the average value of the measurement results of ten pairs of fibers is designated as the intervals among the fibers on the surface of the absorbing member 50 referred to here.

Example 1

The absorbency and surface roughness Rz of the absorbing member 50 as well as the pressing pressure and pressing time of the absorbing member 50 described above will be described below with reference to Examples and Comparative Examples.

First, methods for measuring the absorbency, the surface roughness Rz, the pressing pressure and the pressing time of the absorbing member 50 will be described.

With respect to the absorbency, the target of measurement was not water but ink. The absorbency with respect to ink was measured by a method in accordance with the absorption test based on the Birec method of JIS L 1907. Test pieces were 1 cm wide×20 cm long, an initial immersion length was 3 cm, and the immersion time was 5 min.

The surface roughness Rz is a measured value of the maximum height roughness of ISO 25178 surface properties (measurement of surface roughness). A color 3D laser microscope "VK-8700" by KEYENCE was employed as a measuring instrument.

The pressing pressure was measured by fixing a push pull gauge (FGX-50R by Nidec Shimpo) at the same height as the mounting position of the ink jet head, placing the absorbing member on the pressing base, and pressing the absorbing member against the ink jet head. The amount of time for which the absorbing member is pressed against the ink jet head was designated as an amount of time from a point in time when the pressing pressure reached the values shown in Table 1 through Table 4 below to a point in time when the pressing was ceased.

Next, the evaluation method for each of the conditions will be described. Regarding evaluations, whether ink within the gap 40 of the nozzle guard 32 was removed (removal of gap ink), and whether ink was normally ejected from each nozzle (nozzle check) were evaluated.

First, prior to conducting the evaluations, a purging operation was performed after the ink jet printing apparatus was used for a certain period of time. Next, the wiping operation described above was performed, and a nozzle check pattern which was set in advance was printed on a printing medium 15. Then, by visually checking the printing results, it was confirmed that ink was normally ejected from all of the nozzles. With respect to the purging operation, the amount of ink which was purged through each of the nozzles was set to approximately 4.8 mg/sec.

Next, as an evaluation procedure, the various absorption members 50 shown in Table 1 through Table 4 below were placed on the pressing base 100, and the ink removing unit 29 was controlled to conduct pressing operations at the pressing pressures and the amounts of pressing time shown in Table 1 through Table 4 below, to perform the ink removing operation described above.

With respect to the removal of gap ink, the bottom plate 41 of the nozzle guard 32 (refer to FIG. 3 and FIG. 4) was pressed with a cotton swab after the pressing operation, and evaluations were conducted by visually confirming whether ink seeps out from the gap 40. In Table 1 through Table 4, cases in which no ink seepage was observed were evaluated as "A", cases in which slight seepage of ink was observed were evaluated as "B", and cases in which there was a certain amount of ink seepage were was evaluated as "C". It is preferable for the state of removal of gap ink to be at levels "A" and "B".

With respect to the nozzle check, a nozzle check pattern was printed after the pressing operation described above, and it was visually confirmed whether there were any nozzles from which ink was not normally ejected (ejection dropout). Note that a nozzle from which ink is not normally ejected is a nozzle in which breakage of a meniscus causes ejection failure. The number of nozzles that exhibit ejection dropout was counted per each single ink jet head 31. In Table 1 through Table 4 below, cases in which the number of nozzles that exhibited ejection dropout was 0 or greater and 3 or less were evaluated as "A", cases in which the number of nozzles that exhibited ejection dropout was 4 or greater and 9 or less were evaluated as "B", and cases in which the number of nozzles that exhibited ejection dropout was 10 or greater were evaluated as "C". Note that the number of nozzles in one ink jet head 31 is 508. It is preferable for ejection dropout to be at levels "A" and "B".

Next, specific Examples will be described. Table 1 shows the results of evaluations of ink removal from gaps and ejection dropout when the pressing operation described above was performed with Examples 1 to 11 shown in Table 1 that employed various absorbing members 50 having different absorbencies and surface roughnesses Rz at the pressing pressures and amounts of pressing time shown in Table 1. Here, all of the pressing pressures were set to 30 kPa, and all of the amounts of pressing time were set to 10 seconds.

From the evaluation results shown in Table 1, it was found that it is preferable for the absorbency of the absorbing member 50 to be within a range of 10 mm/5 min or greater and 80 mm/5 min or less. In addition, it was found that it is preferable for the surface roughness Rz of the absorbing member 50 to be within a range of 410 μm or less.

TABLE 1

| | Absorbing Member | Material | Surface Roughness Rz(μm) | Absorbency (mm/5 min) | Pressing Pressure (kPa) | Pressing Time (seconds) | Gap Ink Removal | Nozzle Check |
|---|---|---|---|---|---|---|---|---|
| Example 1 | ASPURE Wiper (TM) | Polyester | 322.99 | 70 | 30 | 10 | A | A |
| Example 2 | Sponge Cloth | Cellulose 70% Cotton 30% | 322.31 | 80 | 30 | 10 | A | A |
| Example 3 | Printing Paper Arabel (TM) | Cellulose | 119.52 | 10 | 30 | 10 | A | B |
| Example 4 | Water Color Paper | Cellulose | 173.43 | 20 | 30 | 10 | A | A |
| Example 5 | Sofras (TM) | Polyurethane | 140.63 | 70 | 30 | 10 | A | A |
| Example 6 | Acoustic Mute Board (AMB) | Polyester | 340.6 | 80 | 30 | 10 | A | A |
| Example 7 | Cloth | Rayon 80% Polyester 20% | 322.73 | 70 | 30 | 10 | A | A |
| Example 8 | Felt 1 | Wool 60% Rayon 40% | 358.88 | 70 | 30 | 10 | A | A |
| Example 9 | Felt 2 | Wool 60% Rayon 40% | 414.78 | 70 | 30 | 10 | A | C |
| Example 10 | Printing Paper Van Nouveau (TM) | Cellulose | 169.21 | 5 | 30 | 10 | C | C |
| Example 11 | Office Paper PW | Cellulose | 189.87 | 5 | 30 | 10 | C | C |

Next, Table 2 shows the results of evaluation by changing the pressing pressure employing the absorbing member 50 (printing paper Arabel (registered trademark)) of Example 3, which has an absorbency at the lower limit value. All of the amounts of pressing time were set to 10 seconds.

From the evaluation results shown in Table 2, it was found that it is preferable for the pressing pressure to be 10 kPa or greater and 80 kPa or less. Note that it is considered that the pressing pressure was excessively low for Example 17, and therefore removal of gap ink was evaluated as "C". It is also considered that the pressing pressure was excessively high for Example 18, and therefore meniscuses were broken and nozzle check was evaluated as "C".

TABLE 2

| | Absorbing Member | Material | Surface Roughness Rz (μm) | Absorbency (mm/5 min) | Pressing Pressure (kPa) | Pressing Time (seconds) | Gap Ink Removal | Nozzle Check |
|---|---|---|---|---|---|---|---|---|
| Example 12 | Printing Paper Arabel (TM) | Cellulose | 119.52 | 10 | 10 | 10 | B | A |
| Example 13 | Printing Paper Arabel (TM) | Cellulose | 119.52 | 10 | 15 | 10 | A | A |
| Example 14 | Printing Paper Arabel (TM) | Cellulose | 119.52 | 10 | 30 | 10 | A | A |
| Example 15 | Printing Paper Arabel (TM) | Cellulose | 119.52 | 10 | 50 | 10 | A | A |
| Example 16 | Printing Paper Arabel (TM) | Cellulose | 119.52 | 10 | 80 | 10 | A | A |
| Example 17 | Printing Paper Arabel (TM) | Cellulose | 119.52 | 10 | 5 | 10 | C | A |
| Example 18 | Printing Paper Arabel (TM) | Cellulose | 119.52 | 10 | 100 | 10 | A | C |

Next, Table 3 shows the results of evaluations that were conducted by changing the pressing time using the absorbing member 50 (acoustic mute board (AMB)) of Example 6, which had an absorbency at the upper limit value. All of the pressing pressures were set to 30 kPa.

From the evaluation results shown in Table 3, it was found that it is preferable for the amount of pressing time to be 7 seconds or greater and 60 seconds or less. It is considered that the amount of pressing time was too short for Example 24, and therefore before the ink seeped out from the gap 40 of the nozzle guard 32 was absorbed by the absorbing member 50, the ink reached the ink ejection outlets 37 of the nozzles, resulting in ejection failures and an evaluation of "C" for nozzle check. In addition, it is considered that the amount of pressing time was too long for Example 25, resulting in meniscuses being broken and an evaluation of "C" for nozzle check.

TABLE 3

| | Absorbing Member | Material | Surface Roughness Rz (μm) | Absorbency (mm/5 min) | Pressing Pressure (kPa) | Pressing Time (seconds) | Gap Ink Removal | Nozzle Check |
|---|---|---|---|---|---|---|---|---|
| Example 19 | Acoustic Mute Board (AMB) | Polyester | 340.6 | 80 | 30 | 7 | A | A |
| Example 20 | Acoustic Mute Board (AMB) | Polyester | 340.6 | 80 | 30 | 10 | A | A |
| Example 21 | Acoustic Mute Board (AMB) | Polyester | 340.6 | 80 | 30 | 20 | A | A |
| Example 22 | Acoustic Mute Board (AMB) | Polyester | 340.6 | 80 | 30 | 30 | A | A |
| Example 23 | Acoustic Mute Board (AMB) | Polyester | 340.6 | 80 | 30 | 60 | A | A |
| Example 24 | Acoustic Mute Board (AMB) | Polyester | 340.6 | 80 | 30 | 5 | A | C |
| Example 25 | Acoustic Mute Board (AMB) | Polyester | 340.6 | 80 | 30 | 90 | A | C |

Next, the results of evaluations that were conducted employing the absorbing member 50 of Example 3 (printing paper Arabel (registered trademark)), which had an absorbency at the lower limit value with pressing pressures of 10 kPa and 80 kPa, and amounts of pressing time of 7 seconds and 60 seconds, based on the evaluation results of Table 1 through Table 3, are shown in Table 4 (Example 26 through Example 29). In addition, the results of evaluations that were conducted employing the absorbing member 50 of Example 6 (AMB), which had an absorbency at the upper limit value with pressing pressures of 10 kPa and 80 kPa, and amounts of pressing time of 7 seconds and 60 seconds are also shown in Table 4 (Example 30 through Example 33).

From the results shown in Table 4, it was found that it is preferable for the absorbency of the absorbing member 50 to be 10 mm/5 min or greater and 80 mm/5 min or less, for the pressing pressure to be 10 kPa or greater and 80 kPa or less, and for the amount of pressing time to be 7 seconds or greater and 60 seconds or less.

TABLE 4

| | Absorbing Member | Material | Surface Roughness Rz (μm) | Absorbency (mm/5 min) | Pressing Pressure (kPa) | Pressing Time (seconds) | Gap Ink Removal | Nozzle Check |
|---|---|---|---|---|---|---|---|---|
| Example 26 | Printing Paper Arabel (TM) | Cellulose | 119.52 | 10 | 10 | 7 | A | A |
| Example 27 | Printing Paper Arabel (TM) | Cellulose | 119.52 | 10 | 10 | 60 | A | A |
| Example 28 | Printing Paper Arabel (TM) | Cellulose | 119.52 | 10 | 80 | 7 | A | A |
| Example 29 | Printing Paper Arabel (TM) | Cellulose | 119.52 | 10 | 80 | 60 | A | A |
| Example 30 | Acoustic Mute Board (AMB) | Polyester | 340.6 | 80 | 10 | 7 | A | A |
| Example 31 | Acoustic Mute Board (AMB) | Polyester | 340.6 | 80 | 10 | 60 | A | A |
| Example 32 | Acoustic Mute Board (AMB) | Polyester | 340.6 | 80 | 80 | 7 | A | A |
| Example 33 | Acoustic Mute Board (AMB) | Polyester | 340.6 | 80 | 80 | 60 | A | A |

The following additional items will be disclosed with respect to the present invention.

(Additional Items)

The wiping device of the present invention may be equipped with a control unit that transitions among a state in which the wiping blade is immersed in the cleaning tank, a state in which the tip of the wiping blade is brought into contact with the ink ejection surface to perform wiping, and a state in which the cleansing solution is sprayed onto the wiping blade by the spraying unit.

In addition, the wiping device of the present invention may be equipped with a rotational driving unit that has a rotation shaft provided at a position along a direction in which the wiping blade extends and that rotates the wiping blade about the rotational shaft. The control unit is capable of controlling the rotational driving unit to rotate the wiping blade, thereby transitioning among a state in which the wiping blade is immersed in the cleaning tank, a state in which the tip of the wiping blade is brought into contact with the ink ejection surface to perform wiping, and a state in which the cleansing solution is sprayed onto the wiping blade by the spraying unit.

Further, in the wiping device of the present invention, the spraying unit may spray the cleansing solution onto the wiping blade after wiping is performed.

Still further, in the wiping device of the present invention, the control unit may reciprocally rotate the wiping blade by controlling the rotational driving unit during the operation of spraying the cleansing solution onto the wiping blade after wiping is performed.

In addition, in the wiping device of the present invention, the control unit may reciprocally rotate the wiping blade by controlling the rotational driving unit after the operation of spraying the cleansing solution onto the wiping blade.

Further, in the wiping device of the present invention, the control unit may reciprocally rotate the wiping blade below a horizontal plane that includes the rotational shaft of the wiping blade.

Still further, in the wiping device of the present invention, the spraying unit may spray the cleansing solution onto the wiping blade before wiping is performed.

In addition, in the wiping device of the present invention, the spraying unit may have a spray pressure when spraying the cleansing solution prior to wiping and a spraying pressure when spraying the cleansing solution following wiping is performed which are different.

The first ink jet printing apparatus of the present invention is equipped with an ink jet head having a nozzle row in which a plurality of nozzles for ejecting ink are arranged and a nozzle guard with an opening at a portion corresponding to the nozzle row, provided with gap with respect to an ink ejection surface of the nozzle row, an ink removing unit that performs an ink removing operation to remove ink which is adhered to the ink ejection surface by pressing an absorbing member that absorbs ink against the opening of the nozzle guard and the ink ejection surface, and a control unit that controls the ink jet head and the ink removing unit, the control unit causing the ink jet head to eject ink at a predetermined pressure to perform a purging operation, and causing the ink removing unit to perform an ink removing operation.

In the first ink jet printing apparatus of the present invention, the ink removing unit may be equipped with a conveyance unit that unwinds a rolled absorbing member, which is an absorbing member wound in the shape of a roll, and conveys the unwound absorbing member such that it faces the ink ejection surface of the ink jet head, and a pressing unit that moves the absorbing member which is conveyed by the conveyance unit toward the ink ejection surface to press the absorbing member against the opening of the nozzle guard and the ink ejection surface.

In addition, in the first ink jet printing apparatus of the present invention, a pressing operation may be performed in a region different from a previously performed region in the case that the pressing operation is performed on the absorbing member.

Further, the first ink jet printing apparatus of the present invention may be equipped with a moving unit that moves at least one of the conveyance unit and a pressing unit, and the ink jet head, and the moving unit may move at least one of these components relative to the direction orthogonal to the direction in which the nozzle row extends for a distance equal to the width of the ink jet head, to press the opening of the nozzle guard and the ink ejection surface against different regions of the absorbing member.

Still further, in the first ink jet printing apparatus of the present invention, the conveyance unit may convey the absorbing member such that a new region of the absorbing member is arranged at a position that faces the ink ejection surface after the pressing unit presses different regions of the absorbing member against the opening of the nozzle guard and the ink ejection surface.

In addition, in the first ink jet printing apparatus of the present invention, the conveyance unit may convey the absorbing member for a distance equal to the length of the ink jet head in the direction in which the nozzle row extends, to arrange a new region of the absorbing member at a position that faces the ink ejection surface.

Further, in the first ink jet printing apparatus of the present invention, it is preferable for the absorbency of the absorbing member to be 10 mm/5 min or greater and 80 mm/5 min or less.

Still further, in the first ink jet printing apparatus of the present invention, it is preferable for the ink removing unit to press the absorbing member against the ink jet head with a pressing pressure of 10 kPa or greater and 80 kPa or less for an amount of time 7 seconds or greater and 60 seconds or less.

In addition, in the first ink jet printing apparatus of the present invention, it is preferable for the absorbing member to be formed by fibers which are thicker than the diameter of the nozzles.

Further, in the first ink jet printing apparatus of the present invention, it is preferable for the lengths of the fibers on the surface of the absorbing member to be shorter than the distance from the ink ejection surface of the nozzles to the surface of the nozzle guard.

Still further, in the first ink jet printing apparatus of the present invention, it is preferable for the intervals among the fibers on the surface of the absorbing member to be wider than the arrangement pitch of the nozzles.

In addition, in the first ink jet printing apparatus of the present invention, the conveyance unit may convey a plurality of absorbing members at a position that faces the ink ejection surface, and the pressing unit may press a plurality of absorbing members against the opening of the nozzle guard and the ink ejection surface in a state in which the plurality of absorbing members are stacked.

Further, in the first ink jet printing apparatus of the present invention, the control unit may perform the ink removing operation after a preset standby time has elapsed following the purge operation being performed.

Still further, in the first ink jet printing apparatus of the present invention, the control unit may change the amount of the standby time according to the pressure during purging.

In addition, in the first ink jet printing apparatus of the present invention, the ink removing section may form a meniscus at the ink ejection outlet of the nozzle by performing the ink removing operation.

Further, in the ink jet printing apparatus of the present invention, it is preferable for the surface roughness Rz of the absorbing member to be 410 μm or less.

A second ink jet printing apparatus of the present invention is equipped with an ink jet head having a nozzle row in which a plurality of nozzles for ejecting ink are arranged and a nozzle guard with an opening at a portion corresponding to the nozzle row, provided with gap with respect to an ink ejection surface of the nozzle row, an ink removing unit that performs an ink removing operation to remove ink which is adhered to the ink ejection surface by pressing an absorbing member that absorbs ink against the opening of the nozzle guard and the ink ejection surface, a wiping unit having a wiping blade which is coated with a cleansing solution that performs a wiping operation to wipe the ink ejection surface with the wiping blade, and a control unit that controls ejection of ink from the ink jet head, the ink removing operation performed by the ink removing unit, and the wiping operation performed by the wiping unit, the control unit controlling the ink jet head to eject ink at a predetermined pressure to perform a purging operation, controlling the ink removing unit to perform the ink removing operation, and controlling the wiping unit to perform the wiping operation.

In addition, in the second ink jet printing apparatus of the present invention, the control unit may cause a minute amount of ink ejecting operation to be performed by the ink jet head in a state in which the opening of the nozzle guard is hermetically sealed following the wiping operation and prior to performing a printing process by the ink jet head.

Further, in the second ink jet printing apparatus of the present invention, the control unit may perform the ink removing operation after a preset standby time has elapsed following the purge operation being performed.

Still further, in the second ink jet printing apparatus of the present invention, the control unit may change the amount of the standby time according to the pressure during purging.

In addition, in the second ink jet printing apparatus of the present invention, the ink removing unit may form a meniscus at the ink ejection outlet of the nozzle by performing the ink removing operation.

In the second ink jet printing apparatus of the present invention, it is preferable for the absorbency of the absorbing member to be 10 m/5 min or greater and 80 mm/5 min or less.

In addition, in the second ink jet printing apparatus of the present invention, it is preferable for the surface roughness Rz of the absorbing member to be 410 μm or less.

Further, in the second ink jet printing apparatus of the present invention, it is preferable for the ink removing unit to press the absorbing member against the ink jet head with a pressing pressure of 10 kPa or greater and 80 kPa or less for an amount of time 7 seconds or greater and 60 seconds or less.

What is claimed is:

1. A wiping device comprising:

a wiping blade for wiping an ink ejection surface of a nozzle row of an ink jet head having the nozzle row in which a plurality of nozzles for ejecting ink are arranged;

a cleansing tank in which a cleansing solution is stored and the wiping blade is immersed; and a spraying unit that sprays the cleansing solution onto the wiping blade, wherein the spraying unit sprays the cleansing solution onto the wiping blade after the wiping is performed, wherein during spraying of the cleansing solution onto the wiping blade, the same wiping blade reciprocally rotates back and forth in opposite rotational directions during spraying.

2. The wiping device as defined in claim 1, further comprising:

a control unit that causes the wiping blade to transition among a state in which the wiping blade is immersed in the cleansing tank, a state in which the tip of the wiping blade is brought into contact with the ink ejection surface to perform wiping, and a state in which the cleansing solution is sprayed onto the wiping blade by the spraying unit.

3. The wiping device as defined in claim 2, further comprising:

a rotational driving unit having a rotational shaft provided at a position along a direction in which the wiping blade extends, and that rotates the wiping blade about the rotational shaft;

the control unit controlling the rotational driving unit to rotate the wiping blade to cause the wiping blade to transition among a state in which the wiping blade is immersed in the cleansing tank, a state in which the tip of the wiping blade is brought into contact with the ink ejection surface to perform wiping, and a state in which the cleansing solution is sprayed onto the wiping blade by the spraying unit.

4. The wiping device as defined in claim 3, wherein:

the control unit controls the rotational driving unit to reciprocally rotate the wiping blade during an operation of spraying the cleansing solution onto the wiping blade after the wiping is performed.

5. The wiping device as defined in claim 4, wherein:

the control unit controls the rotational driving unit to reciprocally rotate the wiping blade after the operation of spraying the cleansing solution onto the wiping blade after the wiping is performed.

6. The wiping device as defined in claim 3, wherein:

the spraying unit sprays the cleansing solution onto the wiping blade before the wiping is performed.

7. The wiping device as defined in claim 1, wherein the spraying unit sprays the cleansing solution onto the wiping blade before the wiping is performed by the wiping blade.

8. A wiping device comprising:

a wiping blade for wiping an ink ejection surface of a nozzle row of an ink jet head having the nozzle row in which a plurality of nozzles for ejecting ink are arranged;

a cleansing tank in which a cleansing solution is stored and the wiping blade is immersed;

a spraying unit that sprays the cleansing solution onto the wiping blade after the wiping is performed;

a control unit that causes the wiping blade to transition among a state in which the wiping blade is immersed in the cleansing tank, a state in which the tip of the wiping blade is brought into contact with the ink ejection surface to perform wiping, and a state in which the cleansing solution is sprayed onto the wiping blade by the spraying unit; and a rotational driving unit having a rotational shaft provided at a position along a direction in which the wiping blade extends, and that rotates the wiping blade about the rotational shaft, wherein the control unit controls the rotational driving unit to rotate the wiping blade to cause the wiping blade to transition among a state in which the wiping blade is immersed in the cleansing tank, a state in which the tip of the wiping blade is brought into contact with the ink ejection surface to perform wiping, and a state in which the cleansing solution is sprayed onto the wiping blade by the spraying unit, the control unit controls the rotational driving unit to reciprocally rotate the wiping blade during an operation of spraying the cleansing solution onto the wiping blade after the wiping is performed, and the control unit reciprocally rotates the wiping blade below a horizontal plane that contains the rotational shaft of the rotational driving unit.

9. A wiping device comprising:

a wiping blade for wiping an ink ejection surface of a nozzle row of an ink jet head having the nozzle row in which a plurality of nozzles for ejecting ink are arranged;

a cleansing tank in which a cleansing solution is stored and the wiping blade is immersed;

a spraying unit that sprays the cleansing solution onto the wiping blade after the wiping is performed;

a control unit that causes the wiping blade to transition among a state in which the wiping blade is immersed in the cleansing tank, a state in which the tip of the wiping blade is brought into contact with the ink ejection surface to perform wiping, and a state in which the cleansing solution is sprayed onto the wiping blade by the spraying unit; and a rotational driving unit having a rotational shaft provided at a position along a direction in which the wiping blade extends, and that rotates the wiping blade about the rotational shaft, wherein the control unit controls the rotational driving unit to rotate the wiping blade to cause the wiping blade to transition among a state in which the wiping blade is immersed in the cleansing tank, a state in which the tip of the wiping blade is brought into contact with the ink ejection surface to perform wiping, and a state in which the cleansing solution is sprayed onto the wiping blade by the spraying unit, the spraying unit sprays the cleansing solution onto the wiping blade before the wiping is performed, and the spraying unit sprays the cleansing solution before the wiping is performed and sprays the cleansing solution after the wiping is performed at different spraying pressures.

* * * * *